US011538308B2

(12) United States Patent
Oberberger

(10) Patent No.: US 11,538,308 B2
(45) Date of Patent: Dec. 27, 2022

(54) METHODS, DEVICES AND SYSTEMS FOR USING MULTIPLE RETURN TO PLAYER (RTP) PAYOUT SCHEDULES IN REGULATED CASINO GAMES

(71) Applicant: AKKADIAN ENTERPRISES, Las Vegas, NV (US)

(72) Inventor: Michael M Oberberger, Spring Hill, TN (US)

(73) Assignee: AKKADIAN ENTERPRISES, Las Vegas, NV (US)

( * ) Notice: Subject to any disclaimer, the term of this patent is extended or adjusted under 35 U.S.C. 154(b) by 0 days.

(21) Appl. No.: 16/994,019

(22) Filed: Aug. 21, 2020

(65) Prior Publication Data

US 2021/0065506 A1 Mar. 4, 2021

Related U.S. Application Data

(63) Continuation of application No. 15/719,342, filed on Sep. 28, 2017, now Pat. No. 10,748,379.

(51) Int. Cl.
*G07F 17/32* (2006.01)

(52) U.S. Cl.
CPC ..... *G07F 17/3244* (2013.01); *G07F 17/3286* (2013.01); *G07F 17/3267* (2013.01)

(58) Field of Classification Search
None
See application file for complete search history.

(56) References Cited

U.S. PATENT DOCUMENTS

2007/0129133 A1* 6/2007 Bansemer ..... G07F 17/38 463/16
2009/0061999 A1* 3/2009 Popovich ..... G07F 17/3262 463/26

(Continued)

OTHER PUBLICATIONS

Australian Office Action dated Sep. 22, 2021 in Australian Patent Application 2018341829.

(Continued)

*Primary Examiner* — Damon J Pierce
(74) *Attorney, Agent, or Firm* — Young Law Firm, P.C.

(57) ABSTRACT

A method of determining rewards due to a player playing a regulated gaming machine may comprise providing a game configured such that a plurality of games assets within the game are configured as a corresponding plurality of Wagering Opportunities, the game being further configured to have an overall minimum return to player (RTP) and an overall maximum RTP. Upon receiving a player interaction with a Wagering Opportunity of the plurality of Wagering Opportunities, the game may perform either a) generating a Wagering Event using the accepted funds, a random number and an accessed first payout schedule that defines a first RTP when the player interaction with the Wagering Opportunity causes a first result, the first RTP being at least as great as the overall minimum RTP; or b) generating a Wagering Event using the accepted funds, the random number and an accessed second payout schedule that defines a second RTP when the player interaction with the Wagering Opportunity causes a second result, the second RTP being greater than the first RTP. The player may then be rewarded an amount determined by the random number and the accessed first payout schedule or second payout schedule.

21 Claims, 12 Drawing Sheets

(56) References Cited

U.S. PATENT DOCUMENTS

2016/0284165 A1* 9/2016 Arnone ..... G07F 17/3244
2017/0124812 A1 5/2017 Washington et al.

OTHER PUBLICATIONS

Canadian Office Action dated May 5, 2021 in Canadian Patent Application 3,073,807.

* cited by examiner

METHODS, DEVICES AND SYSTEMS FOR USING MULTIPLE RETURN TO PLAYER (RTP) PAYOUT SCHEDULES IN REGULATED CASINO GAMES

BACKGROUND

Embodiments shown and described herein are directed to methods, devices systems, and computer program products for determining a reward due to players wager-based games in regulated casino games.

BRIEF DESCRIPTION OF THE DRAWINGS

FIG. 12 also shows exemplary tangible, non-transitory computer-readable media having data stored thereon representing sequences of instructions which, when executed by the regulated gaming computing device, cause the regulated gaming computing device to determine rewards due to a player playing a wager-based game, according to embodiments.

DETAILED DESCRIPTION

Figure 1:
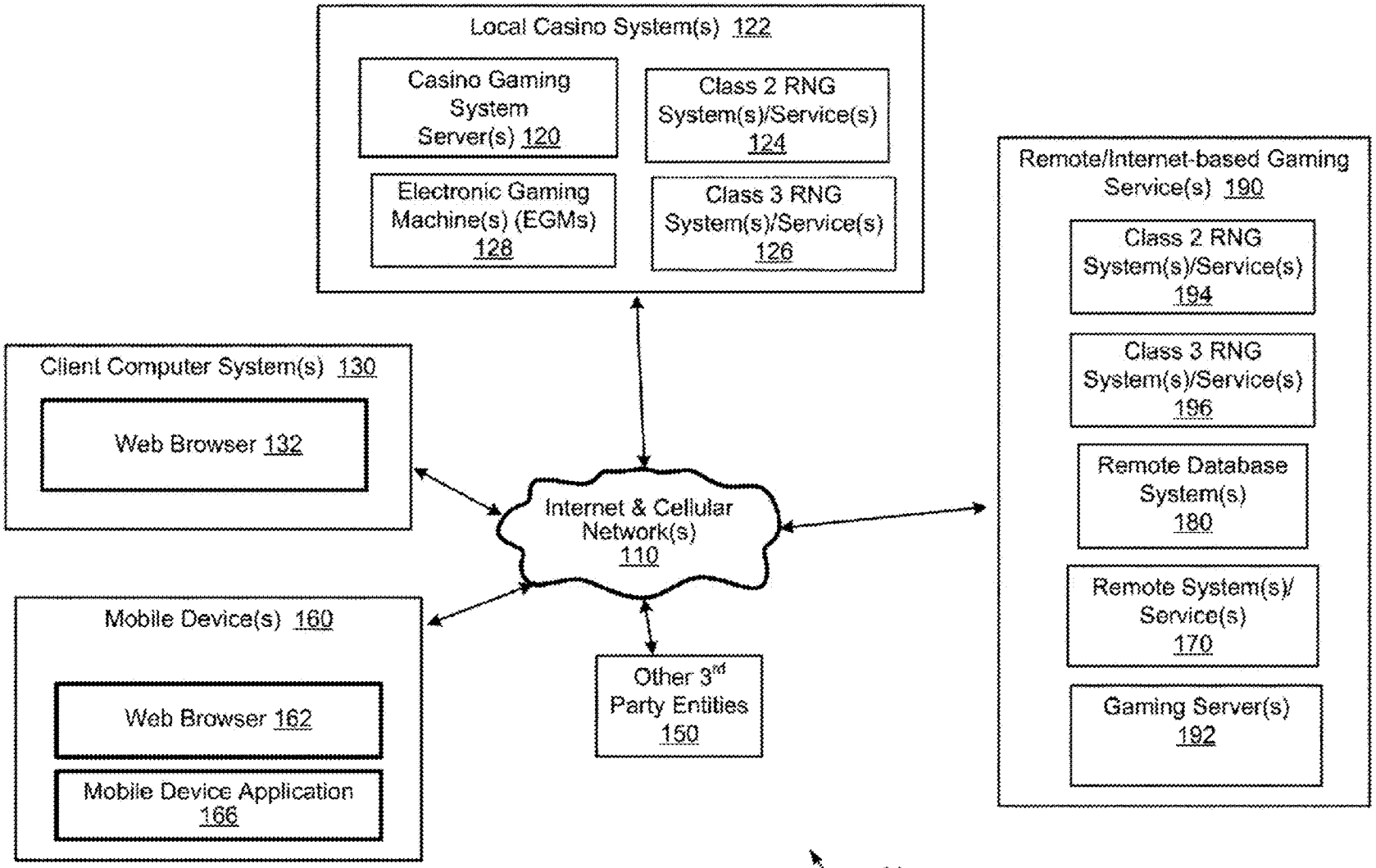
FIG. 1 illustrates a block diagram of a gaming network suitable for implementing embodiments.

Veteran gamblers (e.g., older gambler demographic age 50+) have been accustomed to a standard set of video gaming symbols (e.g., A, J, K, Q from playing cards) which, for example, may be accompanied with a multitude of additional themed symbols (e.g., fruits, animals, fantasy creatures, media personas, etc.) presented on a series of wheels or drums. Newer technology has made possible the use of digital display screens that present the reels and symbols in a digital format. Such existing slot machine technology, however, is dated and may be unappealing to younger players. Indeed, younger gamblers (e.g., also referred to as "gamers"), on the other hand, are accustomed to home gaming consoles (Nintendo, XBOX, PlayStation and the like) that provide them with exquisitely-rendered immersive 2D & 3D game environments with which they can interact. These gamers, who are used to fast paced, energetic, and visually stunning games, feel that the display method of the traditional slot machines are unappealing, which leads to decreased revenue for casino operators.

It is desirable, therefore, to offer hybrid arcade/wager-based games or gambling arcade games that provide hybrid arcade-style, wager-based gaming techniques, which find a ready demographic in younger gamers. However, one significant obstacle regarding such hybrid arcade-style, wager-based gaming techniques is that they often rely on complex back end solutions that require lengthy and costly processes of regulatory review and approvals in many different gaming jurisdictions.

One possible workaround to this significant obstacle is to configure/design a hybrid arcade-style, wager-based game such that it is compliant with currently approved wager-based gaming regulatory standards such as, for example, the well-known GLI standards, which have already been approved in various gaming jurisdictions. One example of a GLI standard is the GLI-11 standard version 3.0, Published Sep. 21, 2016 by Gaming Laboratories International, LLC, which is incorporated herein by reference.

For example, in one embodiment, a hybrid arcade-style, wager-based game may be configured to provide an arcade-style gaming interface which enables a player to participate in an arcade-style game at the wager-based gaming machine. One or more events and/or activities performed by the player (e.g., during play of the arcade-style game) may automatically trigger a random number generator (RNG)-based wager that is compliant with applicable gaming standards, rules and regulations. Because such wager-based activities comply with currently existing GLI standard(s) (and/or other national, regional, local gaming rules and regulations), such hybrid arcade-style, wager-based games may not require additional regulatory approval for deployment in casino venues.

In one embodiment, a hybrid arcade-style, wager-based game may be created by combining a new and different visual game representation with a new and different method of player interaction. The hybrid arcade-style, wager-based game may be configured to provide a perceptually stimulating experience using a wide variety of human interface devices (HID), based on the theme/style of the gambling game at hand. For example, some games may utilize a gun controller for first person shooter games, or steering wheels, accelerator and brake pedals for driving games. These and other types of games and interactions may be adapted for hybrid arcade/wager-based gaming.

For example, the format of the hybrid arcade-style, wager-based game may also focus on other types of video and/or arcade-style games such as, for example, non-linear (e.g., open world) type video and/or arcade-style games such as, for example, Grand Theft Auto, linear type video and/or arcade-style games such as, for example, Half-Life, massively multiplayer online "MMO" type video and/or arcade-style games such as, for example, World of Warcraft, role-playing game "RPG" type video and/or arcade-style games such as, for example, Final Fantasy, and/or others, Such games may feature a player character that may be moved through the game world via player input, (e.g., HID), which allows for an increased sense of excitement through gameplay by providing a multitude of player-choice possibilities through a wide-array of path directions.

In some embodiments, the format of the hybrid arcade-style, wager-based game may facilitate a gameplay environment in which multiplayer functionality takes place. The multiplayer gameplay may have multiple "enrollment" aspects in which one, for example, particular player could be on location at a casino playing a hybrid arcade/wager-based game, while another (e.g., different) player could be at a different location, concurrently participating in the same hybrid arcade/wager-based game, but without participating in any wagering aspect/portions of hybrid arcade/wager-based game. A non-wagering game such as this is commonly known as a "free to play" game, which the player is allowed to download and install on their own devices. The player may then progress through the game (e.g., which is very similar to its the wager based counter-part) without taking part in wager-based events. Gaming situations such as these may promote a "clicks to bricks" outcome where a casino property promotes their games to home users, and invites them to develop familiarity and expertise on non-wagering versions of the games. Later, those same home players may be invited to visit the casinos to play the hybrid arcade/wager version of the games.

In some embodiments, different players concurrently participating in the same hybrid arcade/wager-based game may each separately configure his/her respective wagering parameters/amounts, which may be different from the wagering parameters/amounts configured by other game player-participants.

FIG. 1 illustrates a block diagram of an embodiment of a hybrid arcade/wager-based gaming system 100 which may be implemented via a computer network. At least a portion of the various functions, actions, operations, and activities performed by one or more component(s) of the hybrid arcade/wager-based gaming system may be initiated in response to detection of one or more conditions, events, and/or other criteria satisfying one or more different types of minimum threshold criteria. According to embodiments, at least a portion of the various types of functions, operations, actions, and/or other features provided by the hybrid arcade/wager-based gaming system may be implemented at one or more client systems(s), at one or more system server(s), and/or combinations thereof. According to different embodiments, the present hybrid arcade/wager-based gaming system 100 may be implemented in hardware and/or combinations of hardware and software.

According to one embodiment, a hybrid arcade/wager-based gaming system 100 may include local casino system(s) 122, client computer systems 130, mobile devices 160 and remote/Internet-based gaming services 190 and other 3$^{rd}$ party entities 150, coupled to a computer/communication network 110. The local casino system(s) 122 may include local casino gaming system server(s) 120. The local casino system(s) 122 may also include and class 2 RNG system(s)/service(s) 124. The Class 2 RNG system(s)/service(s) 124 may be configured to dynamically generate and/or provide Class 2 gaming type RNG outcomes to be used by hybrid arcade/wager-based Gaming devices as "predetermined" RNG outcome(s). Class 3 RNG system(s)/service(s) 126 may also be provided to dynamically generate and provide Class 3 gaming "predetermined" RNG outcome(s). Local casino system(s) 122 may also include electronic gaming machine(s) (EGMs) 128 that may be configured as described herein below.

Client computer system(s) 130 may also be operable to couple to the network 110 and implement various types of functions, operations, actions, and/or other features such as those described or referenced herein via, for example, a web browser 132. Similarly, mobile computing devices 160 (e.g., mobile phones, tablets and the like) may be configured to access the network 110 and to use a mobile web browser 162 and/or one or more mobile applications (apps) 166 to implement some or all of the functionality described herein. Third party entities 150 may also be configured to carry out some or all of the functionality described herein via the network 110.

Remote/Internet-based gaming service(s) 190 may also be coupled to network 110 and may comprise class 2 RNG system(s)/service(s) 194 as described relative to reference numeral 124, class 3 RNG system(s)/service(s) 196 as described relative to reference numeral 126, and remote database system(s) 180. Remote system(s)/service(s) 170 may be provided, which may include, for example, content provider servers/services, media streaming servers/services, database storage/access/query servers/services, financial transaction servers/services, payment gateway servers/services, electronic commerce servers/services, event management/scheduling servers/services and/or other services as needed. Remote/Internet-based gaming service(s) 190 may also include gaming servers 192.

According to embodiments, multiple instances or threads of hybrid arcade/wager-based gaming may be concurrently implemented and/or initiated via the use of one or more processors and/or other combinations of hardware and/or hardware and software. Embodiments may access and/or utilize information from one or more associated databases via communication with one or more local and/or remote memory devices.

According to different embodiments, various different types of encryption/decryption techniques may be used to facilitate secure communications over the network 110 and/or via other communication channels. For example, such encryption may utilize random number generators, SHA-1 (e.g., Secured Hashing Algorithm), MD2, MD5, DES (e.g., Digital Encryption Standard), 3DES (e.g., Triple DES), RC4 (e.g., Rivest Cipher), ARC4 (e.g., related to RC4), TKIP (e.g., Temporal Key Integrity Protocol, uses RC4), AES (e.g., Advanced Encryption Standard), RSA, DSA, DH, NTRU, and ECC (e.g., elliptic curve cryptography), PKA (e.g., Private Key Authentication), Device-Unique Secret Key and other cryptographic key data, SSL and/or others. Other security features may include use of well-known hardware-based and/or software-based security components, and/or any other known or yet to be devised security and/or hardware and encryption/decryption processes implemented in hardware and/or software.

Embodiments of hybrid arcade/wager-based gaming described herein may be implemented in hardware and/or a combination of both hardware and software. Possible implementations include in an operating system kernel, in a separate user process, in a library package bound into network applications, on a specially constructed machine, or on a network interface card. In a specific embodiment, various aspects described herein may be implemented in software such as an operating system or in an application running on an operating system.

Alternatively, hardware and/or software embodiments of present hybrid arcade/wager-based gaming techniques described herein may be implemented on a general-purpose programmable computer selectively activated or reconfigured by a computer program stored in memory. Such programmable machine may include, for example, mobile or handheld computing systems, PDA, smart phones, notebook computers, tablets, netbooks, desktop computing systems, system servers, cloud computing systems, network devices, etc.

Figure 2:
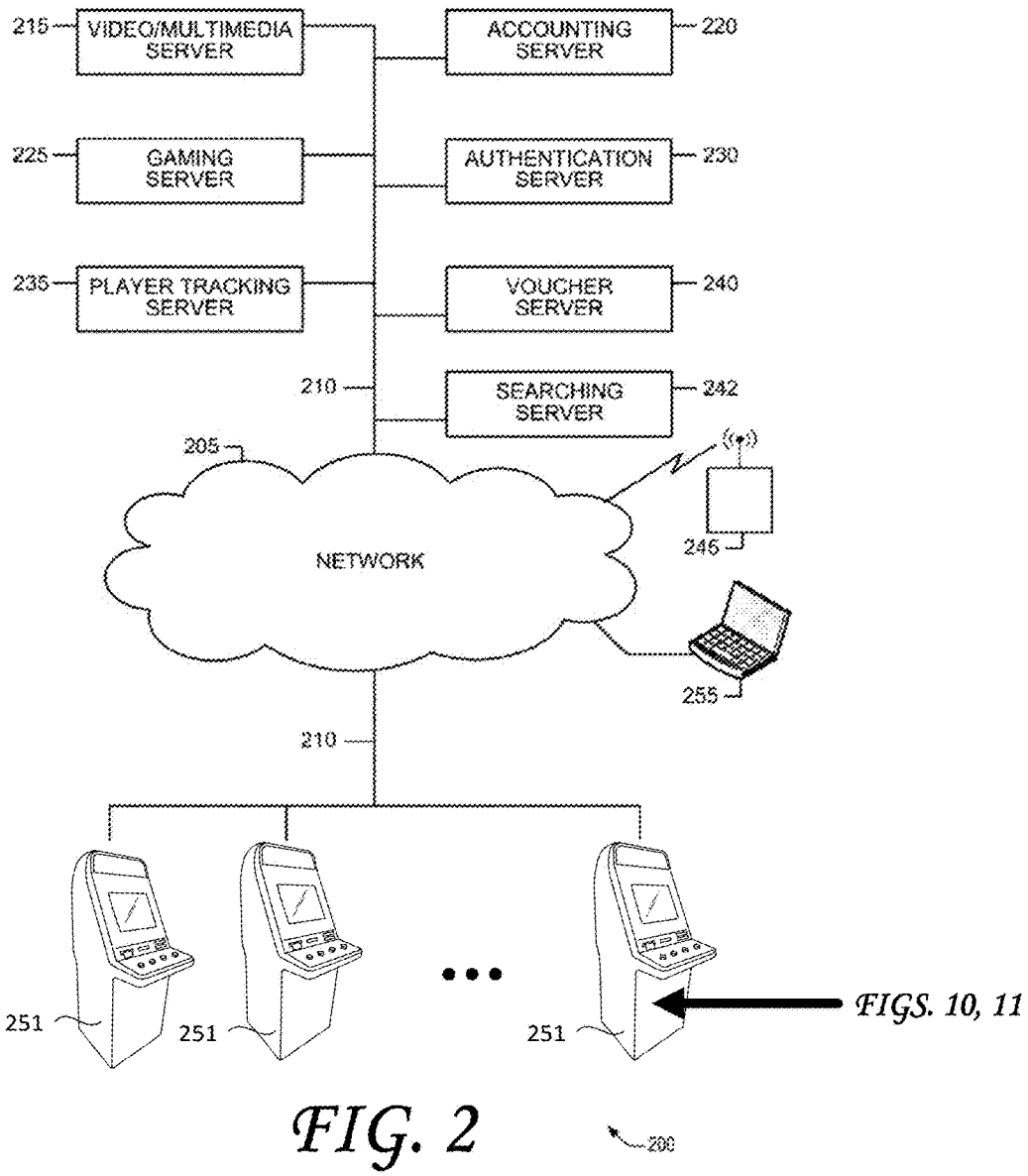
FIG. 2 shows a block diagram of an electronic gaming system according to one embodiment.

FIG. 2 shows an example block diagram of an electronic gaming system 200 according to one embodiment. As shown, electronic gaming system 200 may include electronic gaming devices (EGD) 251 (e.g., electronic gaming terminals, electronic gaming machines, wager-based video gaming machines, etc.), which may be coupled to network 205 via a network link 210. Network 205 may include the internet and/or a private network. One or more video streams may be received at video/multimedia server 215 from EGDs 251. Video/multimedia server 215 may also send one or more video streams to mobile devices 245, 255, EGDs 251, and/or other remote electronic devices. Video/multimedia server 215 may send these video streams via network link 210 and network 205.

Electronic gaming system 200 may include an accounting/transaction server 220, a gaming server 225, an authentication server 230, a player tracking server 235, a voucher server 240, and a searching server 242. The accounting/transaction server 220 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. Accounting/transaction server 220 may also generate tax information relating to these wagers, generate profit/loss and/or other reports for predetermined gaming options, contingent gaming options, predetermined betting structures, and/or outcome categories. Gaming server 225 may generate gaming options based on predetermined betting structures and/or outcome categories. These gaming options may be predetermined gaming options, contingent gaming options, and/or any other gaming option disclosed herein. The authentication server 230 may determine the validity of vouchers, players' identity, and/or an outcome for a gaming event. The player tracking server 235 may track a player's betting activity, a player's preferences such as the player's preferred language, drinks, font, sound level, and the like. Based on data obtained by player tracking server 235, a player may be eligible for gaming rewards (e.g., free play), promotions, and/or other awards (e.g., complimentary food, drinks, lodging, concerts, etc.). Voucher server 240 may generate a voucher, which may include data relating to gaming options. The generated vouchers may be physical (e.g., paper) or digital.

Searching server 242 may implement a search on one or more gaming devices to obtain gaming data. Searching server 242 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching server 242 may implement a wagering function, which may be an automatic wagering mechanism. These functions of searching server 242 may be integrated into one or more servers. Searching server 242 may be configured to, for example, determine which games paid out the most money during a time period, which games kept the most money from players during a time period, which games are most popular (e.g., top games), which games are least popular, which games have the most amount of money wager during a period, which games have the highest wager volume, which games are more volatile (e.g., volatility, or deviation from the statistical norms, of wager volume, wager amount, pay out, etc.) during a time period, and the like. Search may also be associated with location queries, time queries, and/or people queries.

According to embodiments, the gaming network 300 may include a display system server(s) 304 configured manage content (e.g., graphics, images, text, video fees, etc.) to be displayed and/or presented at one or more EGDs, dealer displays, administrator displays, etc. One or more EGD multimedia system server(s) 305 may be provided and coupled to network 310 and configured to manage content (e.g., graphics, images, text, video fees, audio feeds, etc.), which, for example, is to be streamed or provided to one or more EGDs (e.g., or to one or more groups of EGDs). One or more messaging system server(s) 306 may be provided and coupled to network 310 and configured for the management of messaging and/or other communications among and between the various systems, components, devices, EGDs, players, dealers, and administrators of the gaming network. mobile system server(s) 308 may manage communications and/or data exchanged with various types of mobile devices such as player-managed mobile devices (e.g., smart phones, PDAs, tablets, mobile computers), casino-managed mobile devices (e.g., mobile gaming devices). financial system server(s) 312 may be configured to track, manage, report and store financial data and financial transactions relating to one or more hybrid arcade/wager-based game sessions. According to one embodiment, a player tracking system server 314 may include at least one database that tracks each player's hands, wins/losses, bet amounts, player preferences, etc., in the network. In one implementation, the presenting and/or awarding of promotions, bonuses, rewards, achievements, etc., may be based on a player's play patterns, time, games selected, bet amount for each game type, etc. A player tracking system server may also help establish a player's preferences, which assists the casino in their promotional efforts to: award player comps (e.g., loyalty points); decide which promotion(s) are appropriate; generate bonuses and the like. Data tracking & analysis system(s) 318 may be configured to manage and analyze game data. In one embodiment, the data tracking & analysis system(s) may be configured to aggregate multisite hybrid arcade/wager-based gaming trends, local wins and jackpots.

Gaming system server(s) 322, 324 may each be dedicated to one or more specifically designated type(s) of game(s). Each game server may include game logic to host one of more virtual hybrid arcade/wager-based game sessions. At least some game server(s) may also be configured to track of the game accounting (e.g., money in, money out) for a virtual hybrid arcade/wager-based game being played, and/or for updating the financial system servers 312 at the end of each game. The game server(s) 322, 324 may also configured to generate the EGD graphics primitives (e.g., game virtual objects and game states), and may further be operable to update EGDs when a game state change (e.g., new card dealt, player upped the ante, player folds/busts, etc.) is detected. Jurisdictional/regulatory monitoring & enforcement system(s) 350 may be configured to handle tracking, monitoring, reporting, and enforcement of specific regulatory requirements relating to wager-based gameplay activities in one or more jurisdictions.

Authentication & validation system(s) 352 may be configured to determine and/or authenticate the identity of the current player at a given EGD. For example, in one embodiment, the current player may be required to perform a log in process at the EGD in order to access one or more features. Alternatively, the EGD may be adapted to automatically determine the identity of the current player based upon one or more external signals such as, for example, scanning of a barcode of a player tracking card, an RFID tag or badge worn by the current player which provides a wireless signal to the EGD for determining the identity of the current player. In at least one implementation, various security features may be incorporated into the EGD to prevent unauthorized players from engaging in certain types of activities at the EGD. In some embodiments, the authentication & validation system(s) 352 may be configured to authenticate and/or validate various types of hardware and/or software components, such as, for example, hardware/software components residing at a remote EGDs, game play information, wager information, player information and/or identity, etc.

Figure 3:
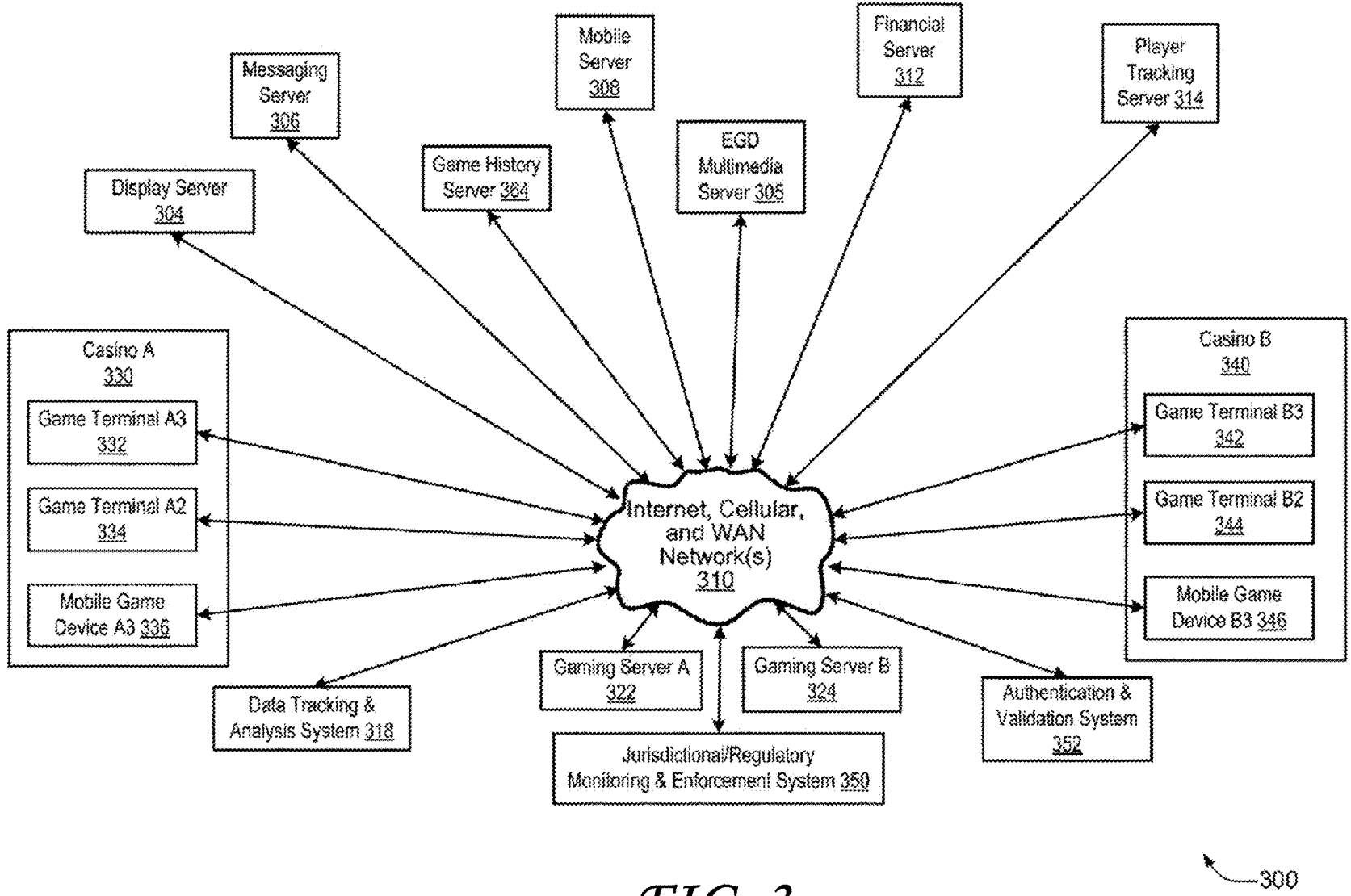
FIG. 3 illustrates a network diagram of gaming network that may be configured to implement embodiments described herein.

Casino venues, shown in FIG. 3 as Casino A 330 and Casino B 340, may correspond to a real-world, physical casino located at a particular geographic location. In some embodiments, a portion of the multiple different casino venues may be affiliated with one another (e.g., Harrah's Las Vegas, Harrah's London). In other embodiments, at least a portion of the multiple different casino venues do not share any affiliation with each other.

EGDs 332, 334, 336, 342, 344, 346 may be configured to enable players to participate in game sessions according to embodiments. Different EGDs may be physically located in one or more different casino venues, and may be connected via a communication network such as shown at 310 in FIG. 3, which may include Internet, Cellular, and WAN Network(s). In some embodiments, EGDs may be implemented as stationary machines. In some embodiments, at least some EGDs may be implemented using mobile devices (e.g., tablets, smartphones, laptops, PC's, and the like).

Game history server(s) 364 may be provided. Game history servers 364 may be configured to track game types and game play history for hybrid arcade/wager-based games. In some embodiments, a game history server may also assist the casino manager in case of disputes between players and the casino by, for example, providing the ability to "replay" (e.g., by virtually recreating the game events) the game in dispute, step by step, based on previously stored game states. Remote database system(s) may be coupled to network 310 and selectively accessible and may be configured to store and provide access to various types of information and data described herein. Remote system server(s)/service(s) may be provided, and configured to provide, for example, content provider servers/services media streaming servers/services database storage/access/query servers/services, financial transaction servers/services, payment gateway servers/services, electronic commerce servers/services, event management/scheduling servers/services and/or other services. Mobile Game Device(s) 336, 346 may be configured to provide the services described below relative to FIG. 6.

According to specific embodiments, a variety of different game states may be used to characterize the state of current and/or past events which are occurring (e.g., or have occurred) at a given EGD. For example, in one embodiment, at any given time in a game, a valid current game state may be used to characterize the state of game play (e.g., and/or other related events, such as, for example, mode of operation of the EGD, etc.) at that particular time. In at least one embodiment, multiple different states may be used to characterize different states or events which occur at the EGD at any given time. In one embodiment, when faced with ambiguity of game state, a single state embodiment forces a decision such that one valid current game state is chosen. In a multiple state embodiment, multiple possible game states may exist simultaneously at any given time in a game, and at the end of the game or at any point in the middle of the game, the EGD may analyze the different game states and select one of them based on certain criteria. Thus, for example, when faced with ambiguity of game state, the multiple state embodiment(s) allow all potential game states to exist and move forward, thus deferring the decision of choosing one game state to a later point in the game. The multiple game state embodiment(s) may also be more effective in handling ambiguous data or game state scenarios.

A variety of different entities may be used (e.g., either singly or in combination) to track the progress of game states which occur at a given gaming EGD. Examples of such entities may include a master controller system, display system, gaming system, local game tracking component(s), remote game tracking component(s), etc. Examples of various game tracking components may include, but are not limited to: automated sensors, manually operated sensors, video cameras, intelligent playing card shoes, RFID readers/writers, RFID tagged chips, objects displaying machine readable code/patterns, etc.

Local game tracking components at the EGD may be operable to automatically monitor game play activities at the EGD, and/or to automatically identify key events which may trigger a transition of game state from one state to another as a game progresses. Depending upon the type of game being played at the gaming table, examples of possible key events may include the start of a new gaming session; the end of a current gaming session; the start of a virtual slot wheel spin; a game start event; a game end event; the detection of an event that triggers the initiation of wager-based event (e.g., killing a zombie, carrying out a predetermined action upon encountering a Wagering Opportunity, and the like); the detection of event that triggers the end of a wager-based event; the detection of event that triggers the initiation or end of a randomized game play event; an initial wager period start or end; a subsequent wager period start or end; or a payout period start or end.

Figure 4:
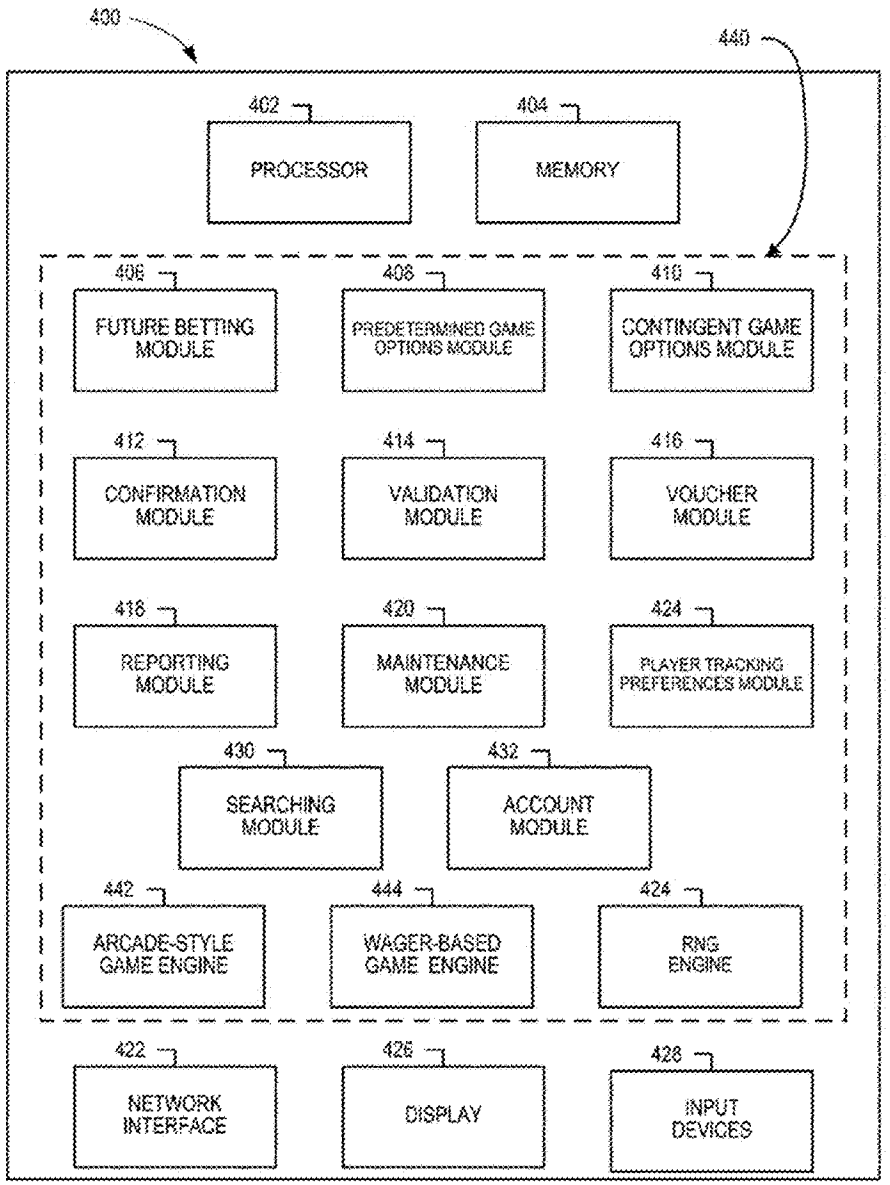
FIG. 4 is a block diagram of electronic gaming device, according to an embodiment.

FIG. 4 shows a block diagram 400 of electronic gaming device 400 according to one embodiment. As shown, electronic gaming device 400 may include a processor 402, a memory 404, a network interface 422, input devices 428, and a display 426. Processor 402 may generate gaming options based on predetermined betting structures and/or outcome categories. Predetermined betting structures may utilize more than one outcome category to generate via processor 402 gaming options. Predetermined betting structures may combine any outcome category with any other outcome category to gaming options. The processor 402 may offer a gaming option that is structured so that the gaming option relates to more than one EGD. Processor 402 may generate contingent gaming options and/or predetermined gaming options. Contingent gaming options 410 may be structures configured such that a wager is activated when a triggering event occurs.

Network interface 422 may be configured to enable the electronic gaming device 400 to communicate with remote devices/systems such as, for example, video/multimedia server(s), accounting/transaction server(s), gaming server(s), authentication server(s), player tracking server(s), voucher server(s) over a communication network, such as shown at 110, 205 and 310. Input devices 428 may be or include mechanical buttons, electronic buttons, one or more touchscreens, microphones, cameras, optical scanners, or any combination thereof. Input devices 428 may be utilized to make a wager, to make an offer to buy or sell a voucher, to determine a voucher's worth, to cash in a voucher, to modify (e.g., change sound level, configuration, font, language, etc.) electronic gaming device 400, to select a movie or music, to select type of content to be displayed on main and/or auxiliary screen(s) of EGD, or any combination thereof.

Arcade-style game engine 442 may be configured to manage the arcade-style game play portion (or entertainment portion) of the hybrid arcade/wager-based game. In contrast, a wager-based game engine 444 may be configured to manage the wager-based game event portion(s) of games according to embodiments. A Random Number Generator (RNG) Engine 446 may be provided and may include software and/or hardware algorithm and/or processes which are used to generate random outcomes, and may be used by the wager-based game engine to generate wager-based game event outcomes.

Display 426 may show video streams from one or more gaming devices, gaming objects from one or more gaming devices, computer generated graphics, predetermined gaming options, and/or contingent gaming options. The memory 404 may include various memory modules 440, including a future betting module 406, a predetermined game options module 408, a contingent game options module 410, a confirmation module 412, a validation module 414, a voucher module 416, a reporting module 418, a maintenance module 420, a player tracking preferences module 424, a searching module 430, and an account module 432.

Future betting module 406 may store data relating to the predetermined betting structure. Processor 402 may utilize data in future betting module 406 to generate predetermined gaming options and/or contingent gaming options. Any other processor (e.g., gaming server 225, any virtualized gaming server, etc.) may implement the functions of processor 402. Predetermined game options module 408 may store data relating to predetermined gaming options, which may be offered to a player. The contingent game options module 410 may store data relating to contingent gaming options, which may be offered to a player. The confirmation module 412 may utilize data received from a voucher, the transaction history of the voucher (e.g., in the case in which the voucher changed hands in a secondary market), and/or the identity of the player to confirm the value of the voucher. In another example, confirmation module 412 may utilize game event data, along with voucher data to confirm the value of the voucher. A validation module 414 may utilize data received from a voucher to confirm the validity of the voucher. Voucher module 416 may store data relating to generated vouchers, redeemed vouchers, bought vouchers, and/or sold vouchers. Reporting module 418 may generate reports related to a performance of electronic gaming device 400, electronic gaming system(s), hybrid arcade/wager-based game(s), video streams, gaming objects, credit device(s) or identification device(s), for example.

In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top tables with the most payouts, top search structures used by players, most popular hybrid arcade/wager-based game(s) by wager volume, most searched for game, hybrid arcade/wager-based game(s) with least payouts, weekly trends, monthly trends, and other statistics related to game plays, wagers, people, location, and searches.

Maintenance module 420 may track any maintenance that is implemented on electronic gaming device 400 and/or electronic gaming system 200. Maintenance module 420 may schedule preventative maintenance and/or request a service call based on a device error. The player tracking preferences module 424 may compile and track data associated with a player's preferences.

Searching module 430 may include one or more searching structures, one or more searching algorithms, and/or any other searching mechanisms. In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In another example, the searching structures may be based on one or more specific games. In another example, the searching structure may be based on a player's preferences, past transactional history, player input, a particular hybrid arcade/wager-based game or game type, a particular EGD, a particular casino, a particular location within a casino, game outcomes over a time period, payout over a time period, and/or any other criteria. Searching algorithms may be dynamic searching programs, which may be modified based on one or more past results, as described previously. In another example, the search algorithm may generate a search priority based on the probability of success various events and/or conditions. In some embodiments, the search algorithm may utilize any dynamic feedback procedure to enhance current and/or future searching results.

Account module 432 may include data relating to an account balance, a wager limit, a number of wagers placed, credit limits, any other player information, and/or any other account information. Data from account module 432 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

In at least one embodiment, at least a portion of the modules discussed in block diagram 400 may reside locally in gaming terminal 400. However, in at least some embodiments, at least part of the functions performed by these modules may be implemented in one or more remote servers. For instance, modules 406-420 and 424 may each be on a remote server, communicating with gaming terminal 400 via a network interface such as Ethernet in a local area network (LAN) or a wide area network (WAN) topology. In some implementations, these servers may be physical servers in a data center. In some other implementations, these servers may be virtualized. In yet some other implementations, the functions performed by these modules may be implemented as web services. For example, the predetermined game options module 408 may be implemented in software as a web service provider. Gaming terminal 400 would make service requests over the web for the available predetermined wager options to be displayed. Regardless of how the modules and their respective functions are implemented, the interoperability with the gaming terminal 400 is seamless. In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top EGDs with the most payouts, top search structures used by players, most popular hybrid arcade/wager-based game(s) by wager volume, most searched for game(s), EGDs with least payouts, weekly trends, monthly trends, and other statistics related to game plays, wagers, people, location, and searches.

Figure 5:
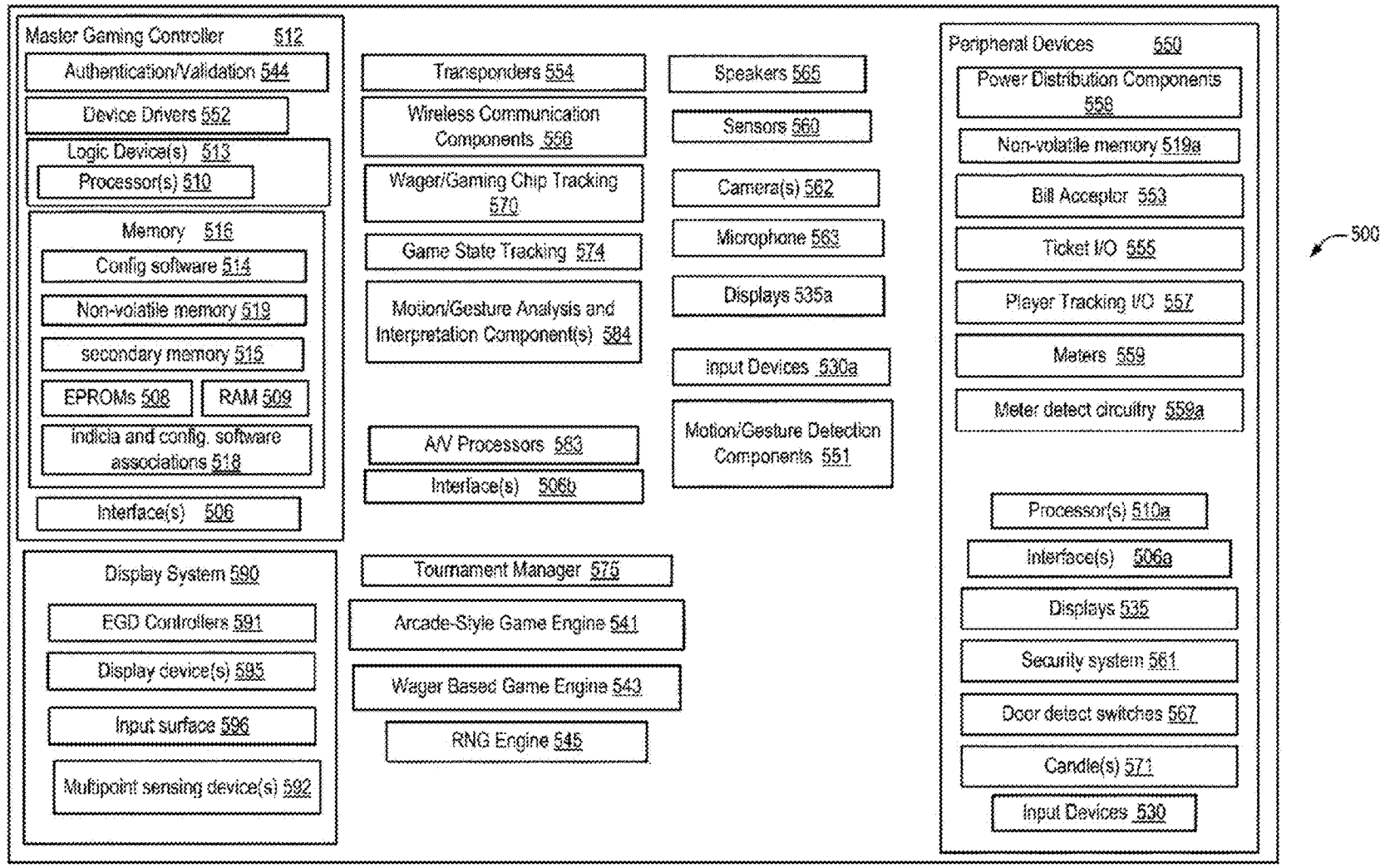
FIG. 5 is a block diagram of an intelligent electronic gaming system, according to one embodiment.

FIG. 5 is a block diagram of an exemplary intelligent multi-player electronic gaming system 500 according to one embodiment. Gaming system 500 may be implemented as a gaming server or as an electronic gaming machine (e.g., EGM) or electronic gaming device (e.g., EGD).

As shown, gaming system 500 may include at least one processor 510, at least one interface 506, and memory 516. Additionally, gaming system 500 may include at least one master gaming controller 512, a multi-touch sensor and display system 590, a plurality of peripheral device components 550, and various other components, devices, systems such as, for example, arcade-style game engine(s) 541; wager-based game engine(s) 543; RNG engine(s) 545; transponders 554; wireless communication components 556; gaming chip/wager token tracking components 570; games state tracking components 574; motion/gesture analysis and interpretation components 584, and audio/video processors 583 which, for example, may include functionality for detecting, analyzing and/or managing various types of audio and/or video information relating to various activities at the gaming system. Various interfaces 506*b* may be provided for communicating with other devices, components and systems, as may be tournament manager 575; sensors 560; one or more cameras 562; one or more microphones 563; secondary display(s) 535*a*; input devices 530*a*; motion/gesture detection components 551; and peripheral devices 550.

The arcade-style game engine(s) 541 may be configured to manage the arcade-style game play portion (or entertainment portion) of the hybrid arcade/wager-based game. Conversely, the wager-based game engine(s) 543 may be configured to manage the wager-based game event portion(s) of the hybrid arcade/wager-based game. RNG engine(s) 545 may include software and/or hardware algorithm and/or processes used to generate random outcomes, and may be used by the wager-based game engine to generate wager-based game event outcomes. Monetary payout manager 522 may be configured or designed to include functionality for determining the appropriate monetary payout(s) (if any) to be distributed to player(s) based on the outcomes of the wager-based game events which are initiated during play of one or more hybrid arcade/wager-based games. The non-monetary payout manager 524 may be configured to include functionality for determining the appropriate non-monetary payout(s) (if any) to be awarded or distributed to player(s) based on the outcomes of the wager-based game events which are initiated during play of one or more hybrid arcade/wager-based games.

One or more cameras (e.g., 562) may be used to monitor, stream and/or record image content and/or video content relating to persons or objects within each camera's view. For example, in at least one embodiment where the gaming system is implemented as an EGD, camera 562 may be used to generate a live, real-time video feed of a player (e.g., or other person) who is currently interacting with the EGD. In some embodiments, camera 562 may be used to verify a user's identity (e.g., by authenticating detected facial features), and/or may be used to monitor or tract facial expressions and/or eye movements of a user or player who is interacting with the gaming system.

In at least one embodiment, display system 590 may include EGD controllers 591; multipoint sensing device(s) 592 (e.g., multi-touch surface sensors/components); display device(s) 595; and Input/touch surface 596. According to embodiments, display surface(s) 595 may include one or more display screens. Master gaming controller 512 may include authentication/validation components 544; device drivers 552; logic devices 513, which may include one or more processors 510; memory 516, which may include configuration software 514, non-volatile memory 519, EPROMS 508, RAM 509, associations 518 between indicia and configuration software, and interfaces 506.

In at least one embodiment, the peripheral devices 550 may include power distribution components 558; non-volatile memory 519*a* (e.g., and/or other types of memory); bill acceptor 553; ticket I/O 555; player tracking I/O 557; meters 559 (e.g., hard and/or soft meters); meter detect circuitry 559*a*; processor(s) 510*a*; interface(s) 506*a*; display(s) 535; independent security system 561; door detect switches 567; candles, etc. 571; input devices 530, for example.

In one implementation, processor 510 and master gaming controller 512 may be included in a logic device 513 enclosed in a logic device housing. The processor 510 may include any conventional processor or logic device configured to execute software (i.e., sequences of computer-readable instructions to be executed) allowing various tasks such as communicating with a remote source via communication interface 506, such as a server that stores authentication information or games; converting signals read by an interface to a format corresponding to that used by software or memory in the gaming system; accessing memory to configure or reconfigure game parameters in the memory according to indicia read from the device; communicating with interfaces, various peripheral devices and/or I/O devices; operating peripheral devices such as, for example, card readers, paper ticket readers, etc.; operating various I/O devices such as, for example, displays 535 and input devices 530. For instance, the processor 510 may send messages including game play information to the displays 535 to inform players of game play/event information, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic and/or chip-card card readers commercially available for reading a player-specific identification information. The player-specific information can be provided on specially constructed magnetic cards issued by a casino, or magnetically coded credit cards or debit cards frequently used with national credit organizations such as Visa, MasterCard, American Express, or banks and other institutions.

The gaming system may include other types of participant identification mechanisms which may use a fingerprint image, eye blood vessel image reader, or other suitable biometric information to confirm identity of the player. Such personalized identification information could also be used to confirm credit use of a smart card, transponder, and/or player's personal player input device (e.g., UID).

The gaming system 500 also includes memory 516 which may include, for example, volatile memory (e.g., RAM 509), non-volatile memory 519 (e.g., disk memory, FLASH memory, EPROMs, etc.), unalterable memory (e.g., EPROMs 508), etc. The memory may be configured or designed to store, for example: 1) configuration software 514 such as all the parameters and settings for a game playable on the gaming system; 2) associations 518 between configuration indicia read from a device with one or more parameters and settings; 3) communication protocols allowing the processor 510 to communicate with peripheral devices and I/O devices 4) a secondary memory storage device 515 such as a non-volatile memory device, configured to store gaming software related information (e.g., the gaming software related information and memory may be used to store various audio files and games not currently being used and invoked in a configuration or reconfiguration); 5) communication transport protocols (e.g., such as, for example, TCP/IP, USB, Firewire, 1EEE1394, Bluetooth, IEEE 802.11x (e.g., IEEE 802.11 standards), hiperlan/2, HomeRF, etc.) for allowing the gaming system to communicate with local and non-local devices using such protocols; etc. In one implementation, the master gaming controller 512 communicates using a serial communication protocol. A few examples of serial communication protocols that may be used to communicate with the master gaming controller include but are not limited to USB, RS-232 and Netplex (e.g., a proprietary protocol developed by IGT, Reno, Nev.).

A plurality of device drivers 552 may be stored in memory 516. Example of different types of device drivers may include device drivers for gaming system components, device drivers for gaming system components, etc. The device drivers 552 may utilize a communication protocol of some type that enables communication with a particular physical device. The device driver abstracts the hardware implementation of a device. For example, a device driver may be written for each type of card reader that may be potentially connected to the gaming system. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (e.g., Wi-Fi), etc. When one type of a particular device is exchanged for another type of the particular device, a new device driver may be loaded from the memory 516 by the processor 510 to allow communication with the device. For instance, one type of card reader in gaming system 500 may be replaced with a second type of card reader where device drivers for both card readers are stored in the memory 516.

The software units stored in the memory 516 may be upgraded as needed. For instance, when the memory 516 is a hard drive, new games, game options, various new parameters, new settings for existing parameters, new settings for new parameters, device drivers, and new communication protocols may be uploaded to the memory from the master gaming controller 512 or from some other external device. As another example, when the memory 516 includes a CD/DVD drive including a CD/DVD designed or configured to store game options, parameters, and settings, the software stored in the memory may be upgraded by replacing a second CD/DVD with a second CD/DVD. In yet another example, when the memory 516 uses one or more flash memory 519 or EPROM 508 units designed or configured to store games, game options, parameters, settings, the software stored in the flash and/or EPROM memory units may be upgraded by replacing one or more memory units with new memory units which include the upgraded software. One or more of the memory devices, such as the hard-drive, may be employed in a game software download process from a remote software server.

The gaming system 500 may also include various authentication and/or validation components 544 which may be used for authenticating/validating specified gaming system components such as, for example, hardware components, software components, firmware components, information stored in the gaming system memory 516, etc.

Sensors 560 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone and/or detecting (e.g., in real time) the presence and/or monetary amount of gaming chips which are within the player's personal space, for example. In one implementation, at least a portion of the sensors 560 and/or input devices 530 may be implemented in the form of touch keys selected from a wide variety of commercially available touch keys used to provide electrical control signals. Alternatively, some of the touch keys may be implemented by a touch-screen display. For example, in at least one implementation, the gaming system player may include input functionality for enabling players to provide their game play decisions/instructions (e.g., and/or other input) to the EGD using the touch keys and/or other player control sensors/buttons. Additionally, such input functionality may also be used for allowing players to provide input to other devices in the casino gaming network (e.g., such as, for example, player tracking systems, side wagering systems, etc.)

Wireless communication components 556 may include one or more communication interfaces having different architectures and utilizing a variety of protocols such as, for example, 802.11 (e.g., Wi-Fi), 802.15 (e.g., including Bluetooth™), 802.16 (e.g., WiMAX), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information. An example of a near-field communication protocol is the ECMA-340 "Near Field Communication-Interface and Protocol (e.g., NFCIP-1)", published by ECMA International (e.g., www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 558 may include, for example, components or devices which are operable for providing wireless power to other devices. For example, in one implementation, the power distribution components 558 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

A motion/gesture detection component(s) 551 may be configured or designed to detect player movements and/or gestures and/or other input data from the player. In some implementations, each gaming system may have its own respective motion/gesture detection component(s). In other embodiments, motion/gesture detection component(s) 551 may be implemented as a separate sub-system of the gaming system which is not associated with any one specific gaming system or device.

Figure 6:
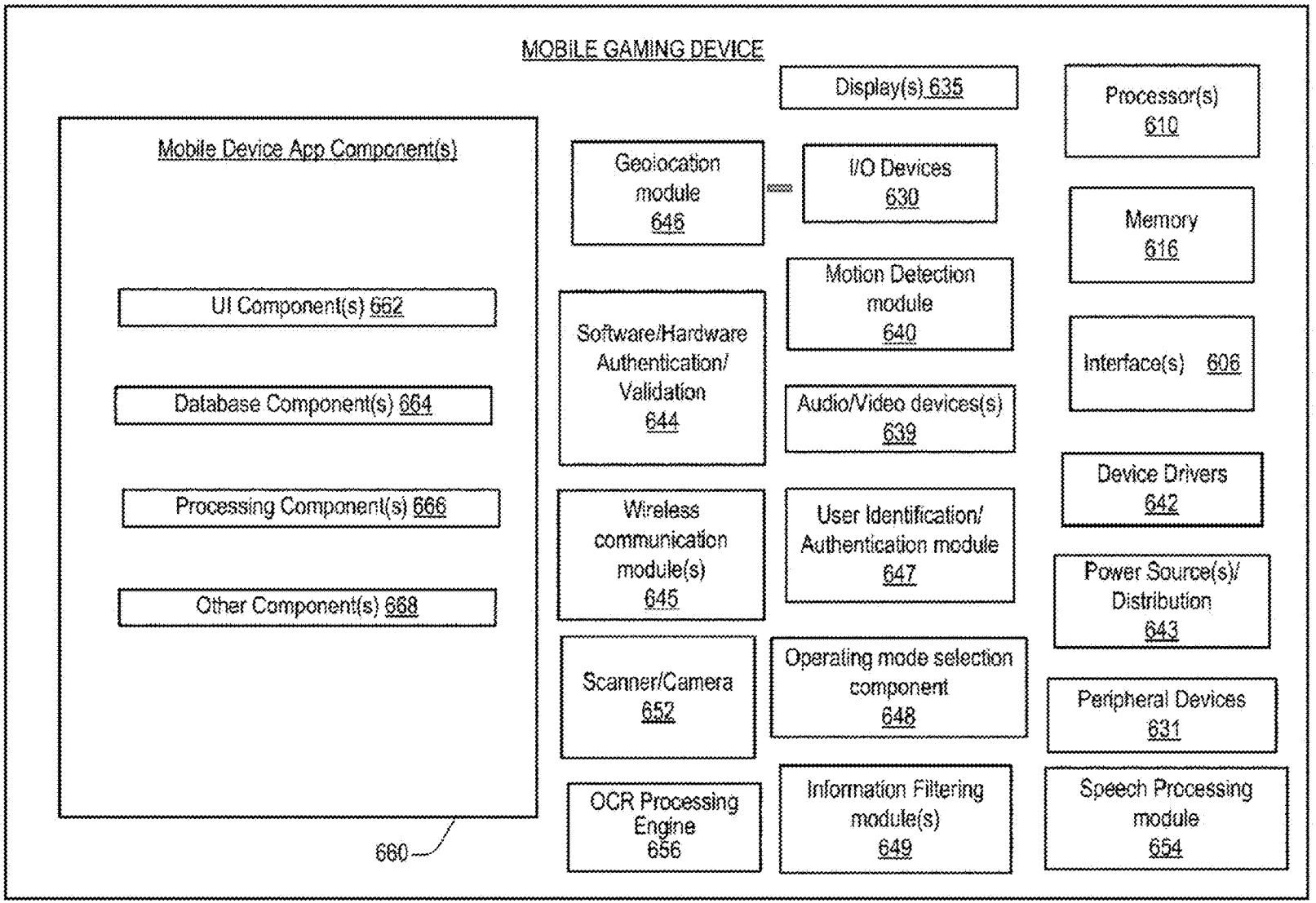
FIG. 6 is a block diagram of a mobile gaming device with which an embodiment may be practiced.

FIG. 6 is a block diagram of an exemplary mobile gaming device 600 in accordance with a specific embodiment. In at least one embodiment, one or more players may participate in a game session using mobile gaming devices. In at least some embodiments, the mobile gaming device may be configured or designed to include or provide functionality which is similar to that of an electronic gaming device (e.g., EGD) such as that described, for example, in FIG. 4.

As shown in FIG. 6, mobile gaming device 600 may include mobile device application components (e.g., 660), which, for example, may include UI components 662; database components 664; processing components 666 and/or other components 668 which, for example, may include components for facilitating and/or enabling the mobile gaming device to carry out the functionality described herein.

The mobile gaming device 600 may include mobile device app component(s) that have been configured or designed to provide functionality for enabling or implementing at least a portion of the functionality of the hybrid arcade/wager-based game techniques at the mobile gaming device.

According to embodiments, various aspects, features, and/or functionalities of the mobile gaming device may be performed, implemented and/or initiated by processor(s) 610; device drivers 642; memory 616; interface(s) 606; power source(s)/distribution 643; geolocation module 646; display(s) 635; I/O devices 630; audio/video devices(s) 639; peripheral devices 631; motion detection module 640; user identification/authentication module 647; client app component(s) 660; other component(s) 668; UI Component(s) 662; database component(s) 664; processing component(s) 666; software/hardware authentication/validation 644; wireless communication module(s) 645; information filtering module(s) 649; operating mode selection component 648; speech processing module 654; scanner/camera 652 and/or OCR processing engine 656, for example.

Figure 7:
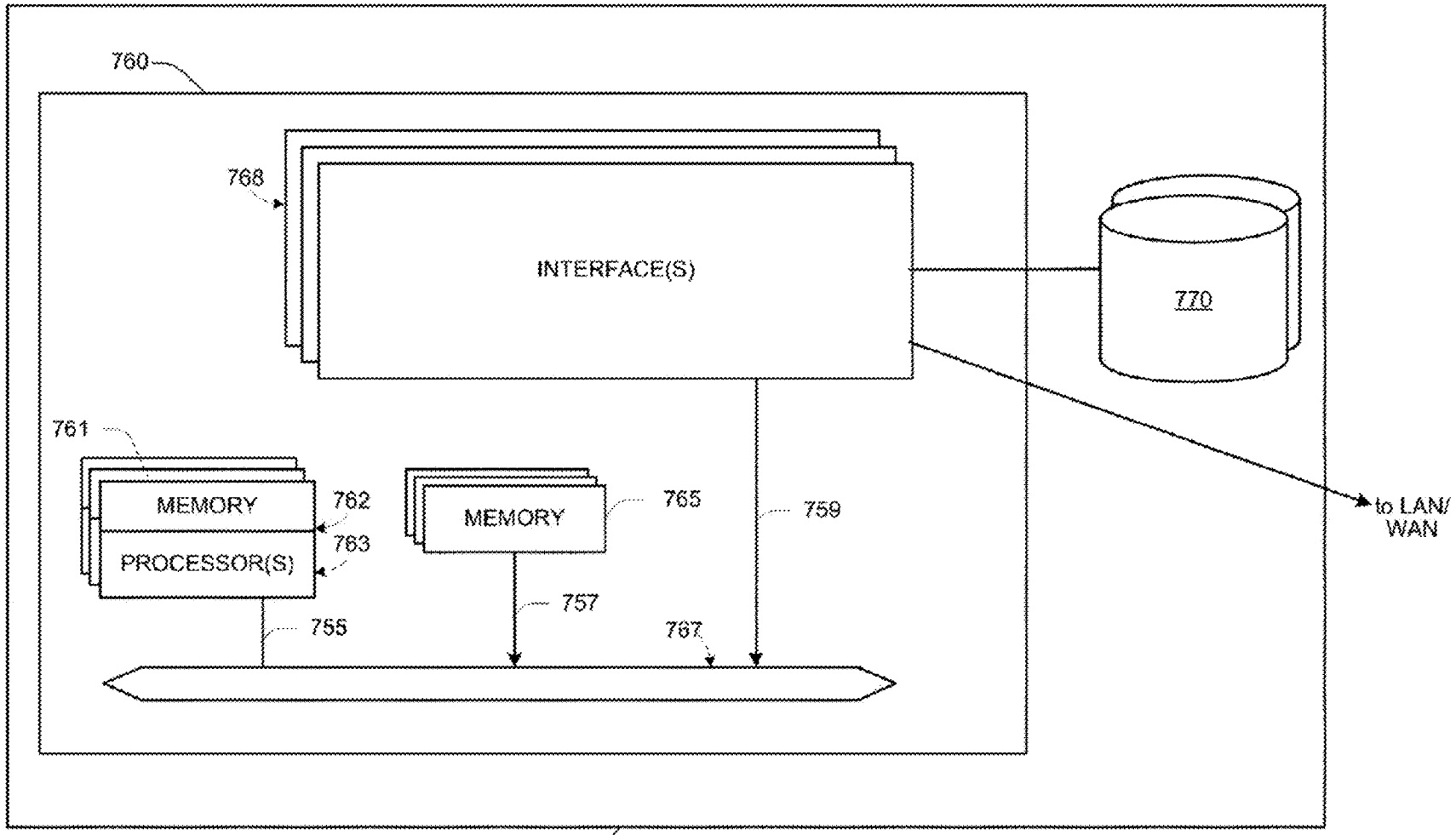
FIG. 7 shows a system server suitable for implementing various aspects of embodiments described herein.

FIG. 7 shows a system server 780 that may be configured according to embodiments. The system server 780 may include at least one network device 760, and at least one storage device 770 (e.g., such as, for example, a direct attached storage device). In one embodiment, system server 780 may be configured to implement at least some of the hybrid arcade/wager-based game techniques described herein. Network device 760 may include a master central processing unit (e.g., CPU) 762, interfaces 768, and a bus 767 (e.g., a PCI bus). When acting under the control of appropriate software or firmware, the CPU 762 may be responsible for implementing specific functions associated with the functions of a desired network device. For example, when configured as a server, the CPU 762 may be responsible for analyzing packets; encapsulating packets; forwarding packets to appropriate network devices; instantiating various types of virtual machines, virtual interfaces, virtual storage volumes, virtual appliances; etc. The CPU 762 preferably accomplishes at least a portion of these functions under the control of software including an operating system (e.g., Linux), and any appropriate system software (e.g., such as, for example, AppLogic (e.g., TM) software).

CPU 762 may include one or more processors 763 such as, for example, one or more processors from the AMD, Motorola, Intel and/or MIPS families of microprocessors. In an alternative embodiment, processor 763 may be specially designed hardware for controlling the operations of system server 780. In a specific embodiment, a memory 761 (e.g., such as non-volatile RAM and/or ROM) also forms part of CPU 762. However, there are different ways in which memory could be coupled to the system. Memory block 761 may be used for a variety of purposes such as, for example, caching and/or storing data, programming instructions, etc.

Interfaces 768 may be typically provided as interface cards. Alternatively, one or more of the interfaces 768 may be provided as on-board interface controllers built into the system motherboard. Generally, they control the sending and receiving of data packets over the network and sometimes support other peripherals used with the system server 780. Among the interfaces that may be provided may be FC interfaces, Ethernet interfaces, frame relay interfaces, cable interfaces, DSL interfaces, token ring interfaces, InfiniB and interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (e.g., Wi-Fi) interfaces, 802.15 interfaces (e.g., including Bluetooth™) 802.16 (e.g., WiMAX) interfaces, 802.22 interfaces, Cellular standards such as CDMA interfaces, CDMA2000 interfaces, WCDMA interfaces, TDMA interfaces, Cellular 3G interfaces, and the like.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 762 to efficiently perform routing computations, network diagnostics or security functions.

In at least one embodiment, some interfaces may be configured or designed to allow the system server 780 to communicate with other network devices associated with various local area network (e.g., LANs) and/or wide area networks (e.g., WANs). Other interfaces may be configured or designed to allow network device 760 to communicate with one or more direct attached storage device(s) 770.

Regardless of network device's configuration, it may employ one or more memories or memory modules (e.g., such as, for example, memory block 765, which, for example, may include random access memory (e.g., RAM)) configured to store data, program instructions, logic and processes for the general-purpose network operations and/or other information relating to the functionality of the embodiments described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (e.g., ROM) and random access memory (e.g., RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 8:
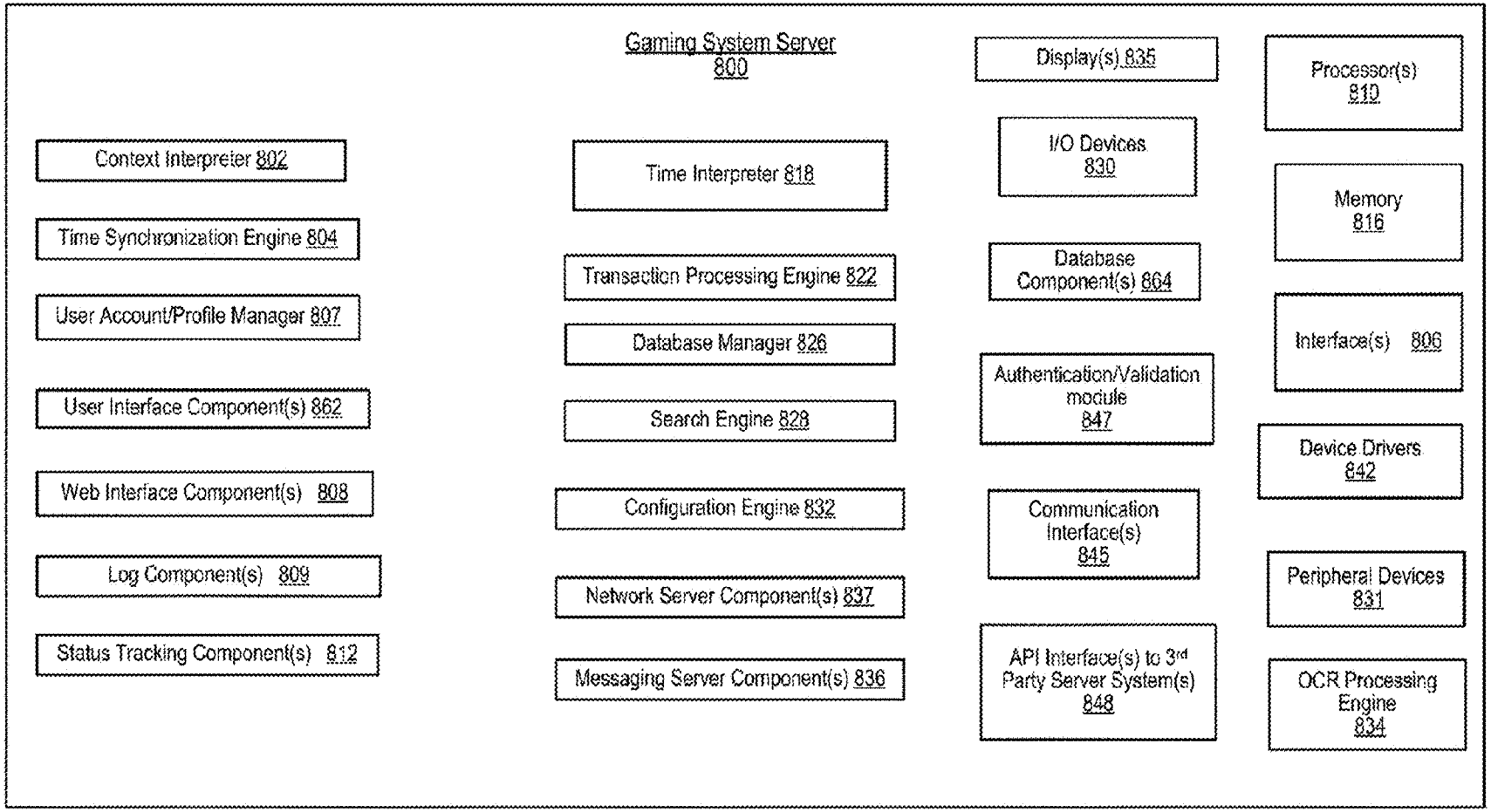
FIG. 8 shows a functional block diagram of a gaming system server according to one embodiment.

FIG. 8 illustrates an example of a functional block diagram of a gaming system server in accordance with a specific embodiment. As shown, the gaming system server 800 may a context interpreter 802 which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). Examples of contextual criteria which may be analyzed may include, but are not limited to, for example, location-based criteria (e.g., geolocation of mobile gaming device, geolocation of EGD, time-based criteria, identity of user(s), user profile information, transaction history information and recent user activities, for example. Time synchronization engine 804 may be operable to manage universal time synchronization (e.g., via NTP and/or GPS). The search engine 828 may be operable to search for transactions, logs, game history information, player information, hybrid arcade/wager-based game information, etc., which may be accessed from one or more local and/or remote databases. The gaming system server 800 may also include a configuration engine 832 that may be configured to determine and handle configuration of various customized configuration parameters for one or more devices, component(s), system(s), and process(es). Time interpreter 818 may be operable to automatically and/or dynamically modify or change identifier activation and expiration time(s) based on various criteria such as, for example, time, location, transaction status, etc. Authentication/validation component(s) 847 (e.g., password, software/hardware info, SSL certificates) may be operable to perform various types of authentication/validation tasks. The transaction processing engine 822 may be operable to handle various types of transaction processing tasks such as, described and/or referenced herein. An OCR processing engine 834 may be operable to perform image processing and optical character recognition of images such as those captured by a gaming device camera, for example. The database manager 826 may be configured to handle various types of tasks relating to database updates, management and access. In at least one embodiment, the database manager may be operable to manage game history databases, player tracking databases and/or other historical record keeping. Log component(s) 809 may be operable to generate and manage transactions history logs, system errors, connections from APIs. Status tracking component(s) 812 may be provided and configured to automatically and/or dynamically determine, assign, and/or report updated transaction status information based, for example, on a state of the transaction. Gateway component(s) may be operable to facilitate and manage communications and transactions with external payment gateways. Web interface component(s) 808 may be operable to facilitate and manage communications and transactions with virtual live electronic gaming device web portal(s). API interface(s) to gaming system server(s) may be operable to facilitate and manage communications and transactions with API Interface(s) to the gaming system server(s). API Interface(s) to 3rd party system server(s) may be provided, which may be operable to facilitate and manage communications and transactions with API interface(s) to 3rd party system server(s).

One or more general-purpose processors 810 may be provided. In an alternative embodiment, at least one processor may be specially designed hardware for controlling the operations of a gaming system. In a specific embodiment, a memory (e.g., such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software. Memory 816 may be provided. The memory 816 may include volatile memory (e.g., RAM), non-volatile memory (e.g., disk memory, FLASH memory, EPROMs, etc.), unalterable memory, and/or other types of memory. According to different embodiments, one or more memories or memory modules (e.g., memory blocks) may be configured or designed to store data, program instructions for the functional operations of the mobile gaming system and/or other information. The program instructions may control the operation of an operating system and/or one or more applications, for example. The memory or memories may also be configured to store data structures, metadata, identifier information/images, and/or information/data relating to other features/functions described herein. Interface(s) 806 may be provided such as, for example, wired interfaces and/or wireless interfaces. Suitable device driver(s) 842 may also be provided, as may be one or more display(s) 835. Messaging server component(s) 836, may provide various functions and operations relating to messaging activities and communications. Similarly, network server component(s) 837 may be configured to provide various functions and operations relating to network server activities and communications. User account/profile manager component(s) 807 may be provided to manage various aspects of user accounts and/or profiles.

Figure 9:
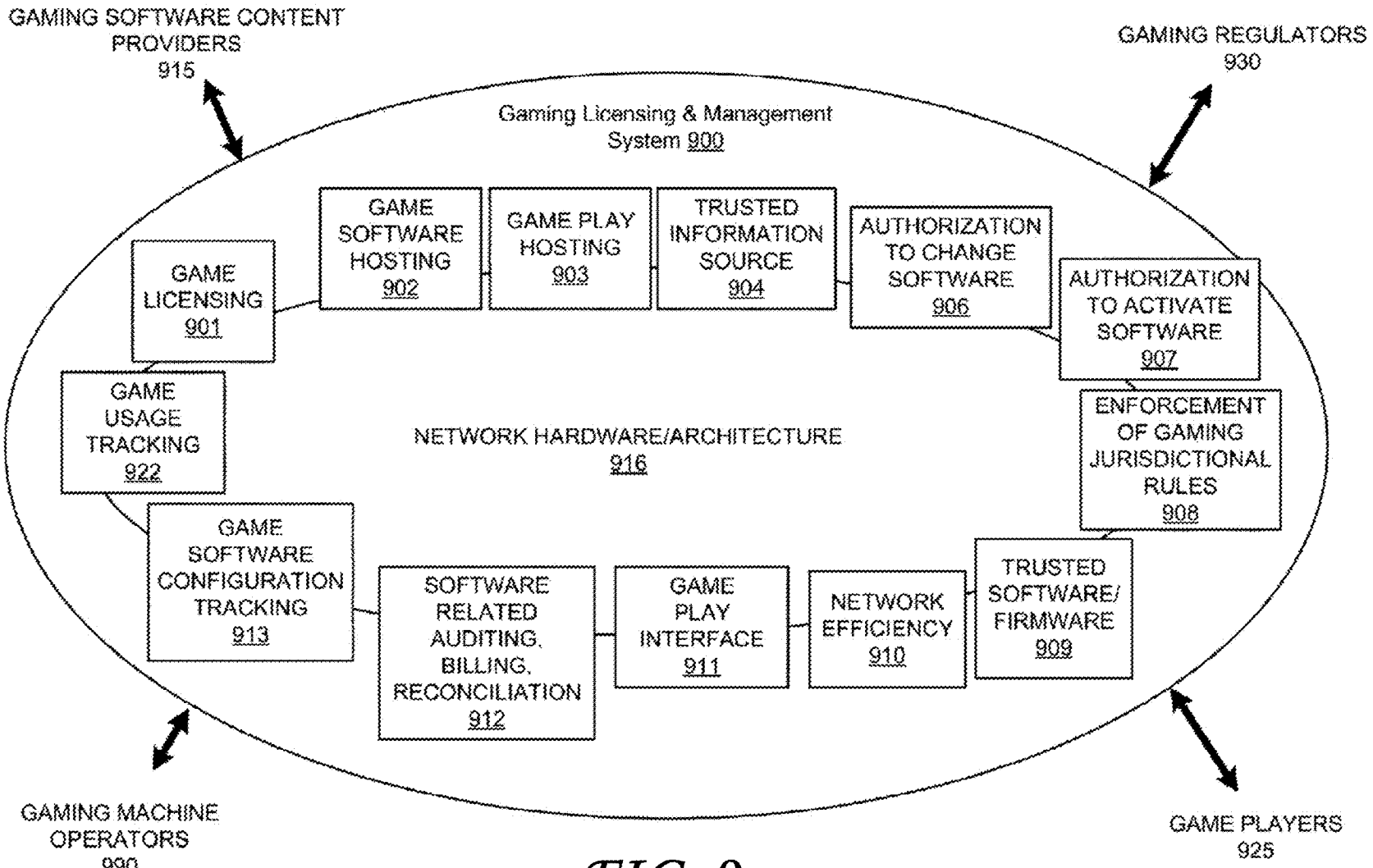
FIG. 9 shows a block diagram illustrating components of a gaming system suitable for implementing an embodiment.

FIG. 9 shows a block diagram illustrating components of a gaming system 900 suitable for implementing various aspects of the embodiments shown and described herein. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 provide rules and regulations that are applicable to the gaming system and receive reports and other information confirming adherence to these rules.

The game software license host 901 may be a server connected to a number of remote gaming devices that provides licensing services to the remote gaming devices. For example, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in use-based licensing schemes, such as a pay-per-use scheme.

In another embodiment, a game usage-tracking host 922 may track the usage of game software on a plurality of devices in communication with the host. The game usage-tracking host 922 may be in communication with a plurality of game play hosts and gaming machines. From the game play hosts and gaming machines, the game usage tracking host 922 may receive updates of an amount that each game available for play on the devices may be played and on amount that may be wagered per game. This information may be stored in a database and used for billing according to methods described in a utility based licensing agreement.

The game software host 902 may provide game software downloads, such as downloads of game software or game firmware, to various devices in the game system 900. For example, when the software to generate the game is not available on the game play interface 911, the game software host 902 may download software to generate a selected game of chance played on the game play interface. Further, the game software host 902 may download new game content to a plurality of gaming machines responsive to a request from a gaming machine operator.

The game software host 902 may also include a game software configuration-tracking host 913. The function of the game software configuration-tracking host is to keep records of software configurations and/or hardware configurations for a plurality of devices in communication with the host (e.g., denominations, number of paylines, paytables, max/min wagers).

A game play host device 903 may include a host server connected to a plurality of remote clients that generates games of chance that are displayed on a plurality of remote game play interfaces 911. For example, the game play host device 903 may include a server that provides central determination of wager outcomes on a plurality of connected game play interfaces 911. As another example, the game play host device 903 may generate games of chance, such as slot games or wager-based video games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

The game play interfaces or other gaming devices in the gaming system 900 may be portable devices, such as electronic tokens, cell phones, smart cards, tablet PCs and PDAs. The portable devices may support wireless communications. The network hardware architecture 916 may be enabled to support communications between wireless mobile devices and other gaming devices in gaming system. The wireless mobile devices may be used to play games of chance, such as described herein.

The gaming system 900 may use a number of trusted information sources. Trusted information sources 904 may include devices, such as servers, that provide information used to authenticate/activate other pieces of information. Cyclic Redundancy Check (CRC) values used to authenticate software, license tokens used to allow the use of software or product activation codes used to activate software are examples of trusted information that might be provided from a trusted information source 904. Trusted information sources may include a memory device, such as an EPROM, that includes trusted information used to authenticate other information. For example, a game play interface 911 may store a private encryption key in a trusted memory device that is used in a private key-public key encryption scheme to authenticate information from another gaming device.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering may be detected.

The gaming system 900 of example embodiments may include devices 906 that provide authorization to download software from a second device to a second device and devices 907 that provide activation codes or information that allow downloaded software to be activated. The devices, 906 and 907, may be remote servers and may also be trusted information sources.

A device 906 that monitors a plurality of gaming devices to determine adherence of the devices to gaming jurisdictional rules 908 may be included in the system 900. A gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRCs, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum wager limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. When a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, e.g., game software approved for use on gaming devices by a local gaming jurisdiction may be required on gaming devices on the gaming machine.

The devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. The software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

In an EGM or EGD, a Payout Schedule for a wager is a randomized monetary Return to a Player. Some alternative industry terms for a Payout Schedule may include Paytable, Payline, Payback Percentage or Distribution. The phrase Payout Schedule is used and defined here to avoid ambiguity that may be inherent in these alternate terms.

In the simplest terms, a Payout Schedule can be described as a table of information. Each of the table's Entries (rows) may include at least three Elements (columns). One of the Elements for an Entry may include some identifying information for a Wagering Event or multiple Wagering Events. Another Element of the Entry may include the Probability (standard mathematical definition) of the Event occurring. The other important Element is the Payback Value for the Wagering Event, should the Wagering Event occur.

The overall Return to the Player (also known as RTP) along with the Payback Values in the table are generally expressed as either (a) a multiple of the Wager or (b) a specific value, such as a dollar (or other currency) amount. All entries in a Payout Schedule should be expressed in the same terms, as mixing Wager multiples and specific values will typically not yield useful information.

In other implementations of a Payout Schedule, these listed values may not be explicitly present in the table, but may instead be indirectly indicated. For instance, if two six-sided dice were used as a lookup into a Payout Schedule, the Probability of a seven (7) being rolled is higher than any other number. If seven was indicated in the actual Payout Schedule, it would be indirectly related to the probability of the 7 being rolled (which is ⅙, or 0.1666666 . . . ) Those of skill in the art will recognize that there are many alternate methods of expressing a Probability, as well as many alternate methods of specifying a Payback Value. For instance, rather than specifying the Payback Value in terms of dollars and cents, or as a multiple of a wager, it could be expressed instead as the value of a "Brand New Car!" or the value of a Progressive Prize. For clarity, this description will assume that Probabilities are real numbers between 0 and 1 inclusive, while Payback Values will either be Multiples of the Wager (expressed as percentages) or constant values (such as one dollar ($1)).

Herein, the sum of all Probabilities in a Payout Schedule will equal 1 in a Complete Payout Schedule. It is acceptable to assume that a paytable has a Missing Entry if the sum of all Probabilities is less than 1. This Missing Entry's Probability is equal to one minus the sum of the existing Probabilities. The Payback Value of the Missing Entry is zero. If the Sum of the Probabilities is greater than one, the Payout Schedule is invalid.

To use a Payout Schedule, a random value must be generated. This random value must be used such that each Entry in the Payout Schedule can be identified using some transformation of the random value combined with some form of look-up into the Payout Schedule using the Probability of each Entry. For example, consider the following Payout Schedule in Table 1:

TABLE 1

| Event | Probability | Payback Value |
|---|---|---|
| Die Roll = 1 or 2 or 3 | .5 | $0 |
| Die Roll = 4 | .166666 . . . | $1 |
| Die Roll = 5 | .166666 . . . | $2 |
| Die Roll = 6 | .166666 . . . | $3 |

The Value of a Payout Schedule is a Sum of Products. Each Entry in the Payout Schedule will have its own Entry Value. This Entry Value is simply the product of the Probability and the Payback Value. The Value of the Payout Schedule is the sum of all Entry Values in the Payout Schedule. Therefore, for the Payout Schedule of Table 1, its Value is calculated as shown below:

$$(0.5*\$0)+(0.166666*\$1)+(0.166666*\$2)+(0.166666*\$3)=\$1.0$$

In this case, if the wager was $1, and the expected Value was $1, the casino (and the player) would expect to neither win nor lose money on this game over time.

Note that random values may have different distributions. Most typical gaming devices use a uniform distribution, as a single random number is used to determine some outcome, such as a reel stop position, a wheel position, the value of a playing card, etc. However, some games or gaming devices may be configured to use a non-uniformly distributed random outcome. One such non-uniform random distribution is the Gaussian distribution. A Gaussian distribution (also known as a Normal distribution) is obtained whenever the sum of multiple uniformly distributed random numbers is calculated. For example, if the sum of two 6-sided dice is used to determine how much to pay the player, the outcome of 7 is more common than any other outcome by virtue of the Gaussian distribution of the random result of summing two 6-sided dice. The outcome is still completely random—it's just not uniformly distributed between 2 and 12. The examples used in this description will assume the generation of random numbers that are uniformly distributed unless otherwise specified. Note, however, that this does not preclude the use of non-uniform distributions in alternate embodiments.

In compliance with virtually all US-based gaming regulations, the randomized return must not be based on any previous actions or outcomes. Therefore, a gaming device is not typically permitted to alter the outcome of a random number generator because the gaming device has paid more or less than some target percentage over time. Therefore, the description and embodiments herein will assume the same constraint.

There are a large number of gambling games that are legal to play in the United States that can be reduced to one or more Payout Schedules. For example, the simple game of Roulette uses a uniformly-distributed random value (the ball landing somewhere on the wheel) along with a set of rules that denote the payout for each of the various possible outcomes. The payout for "black" is usually one-for-one: If you wager $1 on "black", and the ball lands on a "black" number, you will receive $1 for every $1 bet (aka 2 to 1 odds) For this wager, there are 18 black numbers, 18 red numbers, and (hypothetically) 2 green numbers (0 and 00). The frequency of getting black is $18/38$, or roughly 47.4%, and has a value of 2. The frequency of getting "not-black" is roughly 52.6%, and has a value of 0. Therefore, the value to the player (the Payout Schedule Value) for "black" wager on roulette is:

$$(2*47.4\%)+(0*52.6\%)=94.8\%$$

In other words, the casino can expect to win (after many millions of wagers) 1−0.948=0.052, or 5.2 cents, for every dollar wagered on "black" in Roulette. Note: Because no units (currency) was set on the Payback Values, it can be assumed that they are unit-less and, therefore, suitable to be used as a Multiplier for the Wager.

A classic slot machine follows a similar schedule. Each possible combination of symbols on the screen (or on a payline) has a specific Probability of occurring. That combination also has a Payback Value (return to player). This Payback Value may be zero, or it may be millions of dollars. Using the same basic formula that was used in the simple wager of "black" on Roulette, the overall payback percentage of a slot machine is determined by summing up the products of each symbol combination's Probability of occurring and the Payback Value for that combination of symbols.

Over a sufficiently long period of time, the value of a Payout Schedule converges to a constant, designed Value (94.8% in the previous Roulette example). For purposes of calculating the theoretical Return to Player (RTP) of a game, regardless of the individual details comprising a Payout Schedule (Roulette vs. Slot Machine vs. other), if the Values of two Payout Schedules (as calculated above) are the same, then the Theoretical Return to Player for the wager will be the same. As such, the use of the term "Value of the Payout Schedule" is inclusive of every possible way that a payout schedule can be constructed.

For instance, if an example stated: "Carrying out a predetermined action (e.g., collecting a Blue Diamond, eating a Power Pill, etc.) results in the evaluation of a Payout Schedule with a Value of 91%, no assumption should be made about how the Payout Schedule is constructed. In one embodiment, the rolling of a die may be used as the Value of the Payout Schedule. In another embodiment, a slot machine outcome may be used to determine the Value of the Payout Schedule. In yet another embodiment, the spinning of a virtual wheel may be used to determine the Value of the Payout Schedule. For example, a randomized lookup into a lookup-table may be used to establish the Value of the Payout Schedule.

Even if two Payout Schedules have the same Value, the Payout Schedules may have very different Volatilities. In the simplest terms, a Payout Schedule with a higher Volatility will require more wagers to converge to some given Confidence Interval (standard statistical definition) around the Payout Schedule Value than a Payout Schedule with a lower Volatility. In many (if not most) gambling games, combining the theoretical Payback Value with the Volatility is a significant part of the craftsmanship behind mathematical game design. Unless noted otherwise, the Volatility of a Payout Schedule does not affect the use of the term Payout Schedule—two Payout Schedules with the same Value may be considered equivalent in various alternate embodiments and examples described herein. Various terms such as counters, tokens, achievements, etc. will all be called Counters in this description.

Herein, the phrase Wagering Event means a wager instance that is generated as a result of a player interacting with a Wagering Opportunity, or any Wagering Opportunity within a game that is recognized by the game as a Wagering Event. Wagering opportunities may include hardware-based actions such as: pressing a button, pulling a trigger, touching the screen, etc. Wagering Opportunities may also include, but are not limited to, virtual events (events that occur virtually within a video game), such as touching or attempting to touch any game object with a player-controlled avatar (humanoid, vehicle, held weapon or fist, etc.) or having the player's avatar come within a certain proximity of the game object, firing a projectile at any game object (either requiring the projectile to hit or simply be fired, or alternately having the projectile aimed such that it eventually comes within a certain proximity to a game object), making a selection or a move or as the result of making a selection or a move (such as placing an "X" on a Tic-Tac-Toe board, moving your piece in a Monopoly game, sliding a tile or gem in a Match-3 game, etc.), and in general taking any action within a game or allowing any interaction to occur within a game, at any point in time or during or after any duration of time. For any of these opportunities, if a wager has been made prior to, simultaneous with or subsequent to their occurrence, and directly or indirectly because of their occurrence, the combination of the Wager and the occurrence becomes known as a Wagering Event. There may be a myriad of possible Wagering Opportunities within a game. Part of the game's design will be determining which (and when) opportunities may be wagered upon, thereby defining the difference between a Wagering Opportunity and a Wagering Event. Some events may not be or include a Wagering Opportunity until some specific time or upon the occurrence of other predicate event(s).

According to one embodiment, some Wagering Events may occur less frequently, may be associated with a greater time delay within the game, may require a greater degree of dexterity or cleverness and/or may generally be more subjectively difficult to accomplish. Some Wagering Events may be associated with more than one such attribute. Naturally, such Wagering Events may have a higher perceived value to a player than Wagering Events that are associated, for example, with a higher frequency of occurring and/or that require a comparatively lesser degree of dexterity, cleverness and/or that are comparatively easier to accomplish.

In any event, regardless of such attributes that may be associated with one or more Wagering Events, the game must be considered "fair". A primary tenet regarding fairness is that the rules of the game must be completely described to the player, such that the player may make an informed decision whether or not to play the game based on how the game is played. This rule applies to all known regulated gaming jurisdictions. The gaming embodiments shown and described herein are fair and it is assumed that the rules of the game are clearly described to the player.

Also, the game must never pay out so much money that the casino (or other gaming establishment) will consistently lose money to a player that, through luck and/or consistently skillful actions, accomplishes many or all of the Wagering Events. While it is acceptable, for a player that consistently accomplishes most or all Wagering Events that are subjectively more valuable, to win more money (including more than he or she put into the gaming machine) than another player that accomplishes none or a limited number of such subjectively more valuable Wagering Events, the game must be designed in such a manner as to guarantee that the winnings over time, for any player, will not cause the casino to lose money. The embodiments shown and described herein allow for the game designer to guarantee that no player, however, lucky, clever, dexterous or skillful, cannot win more than 100% of his or her wagers over a significantly long period of time. This proposition may be called, in short-hand, the Unacceptably High Payback Rule.

Frequently within a game, there will be Wagering Events that may be subjectively perceived as being more valuable, harder to accomplish, that occur less frequently (collectively, Harder Wagering Events) and there will be Wagering Events that may be subjectively perceived as being comparatively less valuable, easier to accomplish, that occur more frequently (collectively, Easier Wagering Events). For example, in the classic Matching game Bejeweled™ matching 3 gems is considered to be Easier than matching 4 gems. Also, opportunities to match 3 gems may occur more frequently than do opportunities to match a greater number of gems (4, 5, 6, or 7, for example). In a first-person shooter game, a head shot (smaller target, more difficult to hit) may be considered to be Harder and a body shot (larger target, comparatively easier to hit) may be considered to be Easier. Because of basic human nature, players typically expect larger rewards for Harder activities.

According to one embodiment, one way to address this desire for a larger reward is to assign a different and higher-valued Payout Schedule to Harder Wagering Events. Such a paradigm allows for a consistently greater return to the skilled player and for an occasionally greater return for the lucky player. Other embodiments are configured to enhance such a paradigm to both enhance all players' experiences and to protect the casino.

According to one embodiment, each individual wager, placed through the gaming machine receiving some player interaction when the player encounters a Wagering Event, should never have an expected RTP that falls below a specified minimum (such as 75% in Nevada), regardless of game state or game history. According to another embodiment, the overall RTP, over the life of the game, should not exceed some specified maximum, most likely mathematically capped at 100%, even if the player were to successfully and consistently accomplish all available skillful actions required during Wagering Events. It is to be understood that, over the short term, any player may be rewarded more than his or her wagers. However, even if the luckiest and most skilled player in the world were to play a game machine or configured according to one or more of the embodiments shown and described herein for an extended period of time, that player would never be rewarded a return that cost the casino (or other operator) money.

Notwithstanding, according to one embodiment, the expected RTP of an individual Wagering Event within a game may be larger for a Harder Wagering Event than the expected RTP for a comparatively Easier Wagering Event within the same game. It is these Harder (and/or less-frequently occurring) Wagering Events that are associated with a better (for the player) RTP, that keep the player engaged in the game at hand, and that heighten his or her excitement during game play. Engaging gameplay is usually an indicator of higher revenue in the gaming industry. According to one embodiment, an Easier (and/or frequently occurring) Wagering Event may have an expected RTP of (for example) 75%, while a Harder (and/or less frequently occurring) Wagering Event may have an expected RTP of, for example, 85% (or even higher than 100%, as described below) associated therewith.

Figure 10:
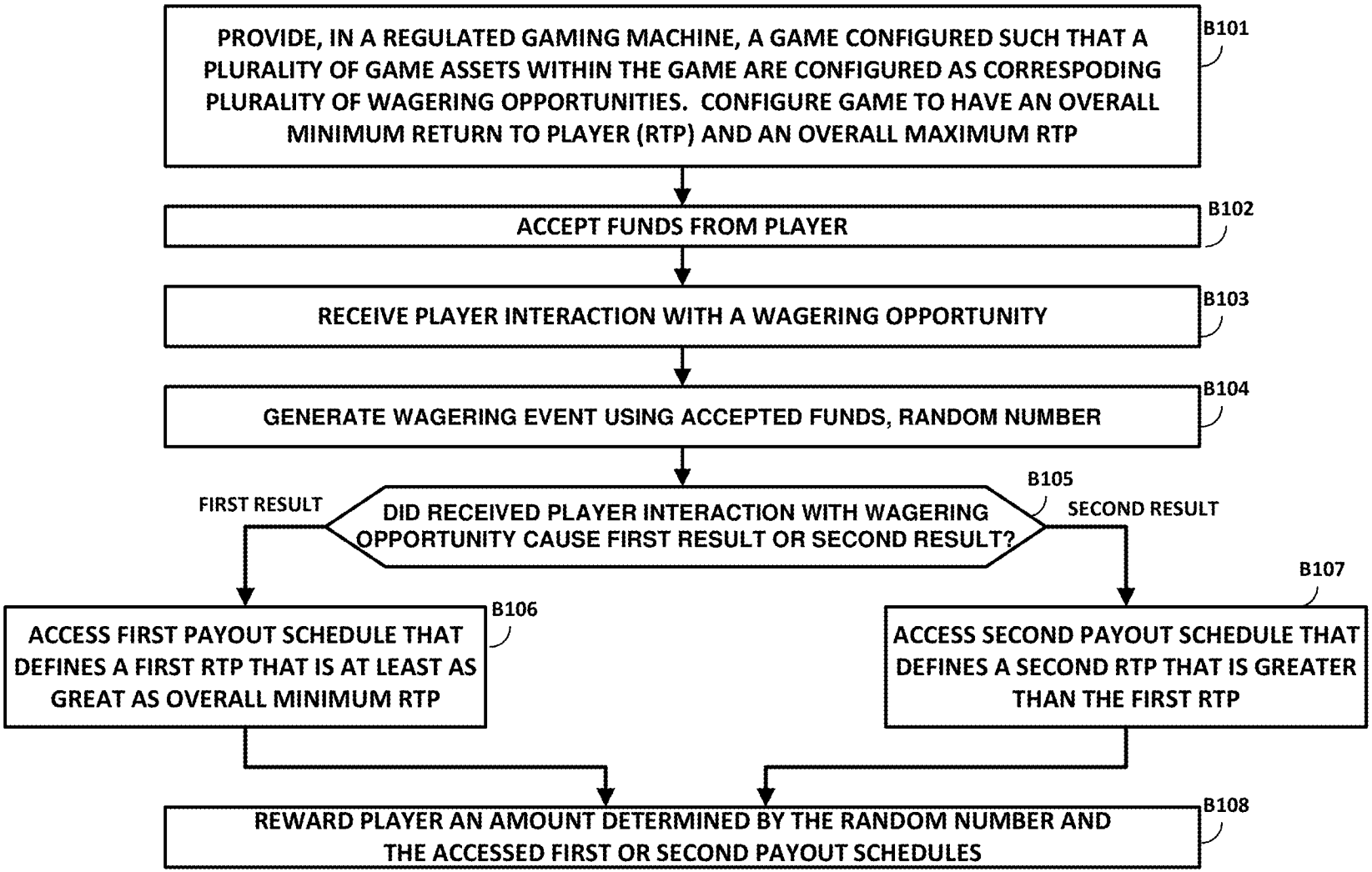
FIG. 10 is a flowchart of a method according to one embodiment.

A method of determining rewards due to a player playing a regulated gaming machine according to one embodiment is shown in FIG. 10. As shown therein, block B101 calls for providing, in the regulated gaming machine, a game in which a plurality of games assets within the game are configured as a corresponding plurality of Wagering Opportunities. Such Wagering Opportunities may be embodied as most any in-game object, feature, creature, person, plant or animal. For example, in a matching game, the in-game assets may be jewels or other objects that the player is trying to match. In a first-person shooter game, the in-game assets configured as Wagering Opportunities may include prey, bad guys, zombies, or avatars of other players, for example. In adventure games, the in-game assets that may be configured as Wagering Opportunities may include maps, tools, useful information, power packs, or any suitable item within the game that may be thematically related to the scripted story. Player interaction with these Wagering Opportunities give rise to corresponding Wagering Events, the outcomes of which may or may not reward the player.

According to embodiments, the game may be further configured to have an overall minimum return to player (RTP) and an overall maximum RTP, as also shown in block B101 in FIG. 10. The overall minimum RTP may vary from gaming jurisdiction to gaming jurisdiction. For example, in the US state of Nevada, the mandated minimum RTP is 75%.

As shown at B102, the method may also include accepting funds from a player. The accepted funds may include paper money, coins, tokens and/or any accepted form of electronic money or value. B103 calls for receiving a player interaction, during the course of the game, with a Wagering Opportunity of the plurality of Wagering Opportunities. For example, the player may interact with the provided game using such input functionality as touch keys and/or other player control sensors/buttons, steering wheel, weapon, joystick, control yoke and/or any other device, system or sensor that enables the regulated gaming machine to accept player input.

Block B104 calls for generating a Wagering Event using the accepted funds and a random number. As shown at B105, it may then be determined whether the player interaction with the Wagering Opportunity results in a first or a second result. As shown, if it is determined that the received player interaction with the Wagering Opportunity caused or is otherwise associated with the first result, the flow branches from B105 to B106. At B106, the game accesses a first Payout Schedule (stored in non-volatile memory in the gaming machine or remotely) that defines a first RTP that is at least as great as (returns as least as much as) the overall minimum RTP of the game. If, however, it is determined at B105 that the received player interaction with the Wagering Opportunity caused or is otherwise associated with the second result, the flow branches from B105 to B107. At B107, the game accesses a second Payout Schedule (stored in non-volatile memory in the gaming machine or remotely) that defines a second RTP that is greater than (returns more than) the first RTP. Thereafter, irrespective of whether the received player interaction caused the first or second result, block B108 is performed; namely to reward the player an amount (if any) that is determined by the random number and the accessed first or second Payout Schedules.

According to embodiments, as noted above, the first result may be more likely to occur during the game than is the second result. This may be due to the designed-for level of difficulty in achieving the second result as compared to the first result and/or the designed scarcity of availability of the second result. That is, the second result may only be selectably available. For example, the game may be configured such that higher-order matches are not always available or such that many of the attacking zombies are headless, making a head shot (an exemplary second result) not achievable in interacting with some Wagering Opportunities. According to one embodiment, the received player interaction that causes the first result may be a less skillful player interaction than the player interaction that causes the second result. Stated differently, the player interaction that causes the second result may be considered to be harder than the player interaction that causes the second result. In any event, according to embodiments, the player interaction(s) causing the first result is different than the player interaction(s) causing the second result. According to one embodiment, interaction with a Wagering Opportunity that causes a third result may not generate a Wagering Event. For example, taking aim at a zombie and missing or mis-matching items (examples of unsuccessful interactions with a Wagering Opportunity) may result in no Wagering Event being generated. Alternatively, a Wagering Event may be generated and the player may lose all or a portion of his or her wager for that Wagering Event.

Embodiments do not assess the skill, cleverness, quickness or any other player attribute nor do embodiments change the RTP based upon any historical record of this or other players' interactions with the game. That is, which one of the first and second payout schedules is accessed in blocks B106 and B107, according to embodiments, is unrelated to past player interactions or previously-achieved first or second results. Indeed, which Payout Schedule is accessed upon determination of the result caused by a player's interaction (s) with a Wagering Opportunity, is based solely upon that player's interaction(s) with the Wagering Opportunity with which the player is currently interacting.

According to embodiments, even when each received player interaction with the plurality of Wagering Opportunities causes the first result, the game returns to the player no less than the overall minimum RTP. Conversely, when each received player interaction with the plurality of Wagering Opportunities causes the second result, the game returns to the player, on average and over many iterations of the game, no more than the overall maximum RTP. Therefore, when some of the received player interactions with the plurality of Wagering Opportunities cause the first result and some others of the received player interactions cause the second result, the method further comprises returning to the player, over the course of the game, an amount between the overall minimum RTP and the overall maximum RTP.

According to further embodiments, a greater number of results may be caused by the received player interaction, causing a corresponding access to other Payout Schedules, at least some defining other RTPs, different volatilities and the like. In other words, embodiments are not limited to implementations comprising only two possible results. Moreover, the random number may be generated at any point prior to the determination of the reward due the player.

As shown in FIG. 10 and as described above, a player may interact with the game and the game may receive one or more signals indicative of the player interaction with a Wagering Opportunity. The player interaction or interactions with the Wagering Opportunity may be such as to cause one, two or more different results. For example, in a zombie first-person shooter, a player interaction with a zombie in-game asset configured as a Wagering Opportunity may cause one of several results. One possible result is that the received player interaction causes harm to the zombie, but does not kill it. Another possible result is that the received player interactions include a number of shots to the zombie's body (so-called body shots), for example. One such shot may not be lethal to the zombie, but a predetermined number of such body shots may be lethal. Yet another possible result is that the received player interaction kills the zombie, in one shot. Such a result may obtain if the received player interaction is a shot to the zombie's head, a so-called head shot, for example. In this example, when the player interaction(s) is (is interpreted as) a body shot(s), the first Payout Schedule is accessed and used to determine the reward (if any) due to the player. When the player interaction is a head shot, the second Payout Schedule is accessed and used to determine the reward (if any) due to the player. Since the body area defines a comparatively greater zombie surface area than the head does, body shots may be defined as being comparatively Easier to accomplish than is a head shot. Therefore, the first RTP defined by the accessed first Payout Schedule may be less advantageous to the player (i.e., have a lower RTP) than the second RTP defined by the accessed second Payout Schedule. Therefore, the first, lower RTP may be associated with the Easier body shot and the second, higher RTP may be associated with the Harder head shot, in this example. In this manner, more skillful actions (head shot or other Harder action) may reward the player, on average, more than comparatively less skillful actions (body shot(s) or other Easier action). Other received player interactions may not be effective to kill the zombie or accomplish the intended action. According to one embodiment, no Wagering Event may be generated upon receipt of such an ineffectual or unsuccessful player interaction.

The method outlined in FIG. 10 may be applied to games other than first person shooters. Indeed, any game in which player interactions may be determined to cause first or second (and higher-order) results may be configured according to embodiments. For example, in a match game, matching 4, 5, 6 or 7 like items may cause the game to access second, third, fourth or fifth Payout Schedules, each with progressively higher (or at least different) RTPs, with a higher RTP generally being correlated and associated with more skillful, clever, dexterous and/or rapid player interactions. For example, in an archery game, hitting the rim and/or outside concentric circles of a target may cause the evaluation of player reward against a first Payout Schedule defining a first, low RTP, whereas hitting the inner rings or the bullseye of the target may cause the game to access a second Payout Schedule defining a second, higher RTP and to use the accessed first or second Payout Schedules in determining the reward (if any) due the player as a result of the Wagering Event generated as a result of his or her interaction with the Wagering Opportunity (hitting the target, in this case).

According to one embodiment, the first result may be more likely to occur during the game than is the second result. That is, player interactions that may be characterized as being Easier may occur (statistically or upon examination of the historical record) more frequently than player interactions that may be characterized as being Harder. In the zombie game example, player interactions that cause a first result (body shots, for example) may historically occur more frequently than player interactions that cause a second result (head shots, for example). Another way of stating this is that the received player interaction that causes the first result (body shot, arrow in the outside rim of the target) may be considered to be a less skillful player interaction than the player interaction that causes the second result (head shot or arrow hitting the target's bullseye). It is also understood that even unskillful player interactions and/or random player interactions may, at least some of the time, result in the second, Harder result. No attempt to measure player skill, dexterity and/or other player attributes is made, according to embodiments.

Moreover, which one of the first and second payout schedules is accessed, according to embodiments, is unrelated to past player interactions or previous first or second results that may have been obtained. Indeed, the decision to use the first, lower RTP, Payout Schedule or use the second, higher RTP, Payout Schedule is unrelated to any skill, dexterity, cleverness the player may have exhibited in his or her prior player interactions with other in-game assets in this or other games. In this manner, the decision as to which Payout Schedule to use may be based, according to one embodiment, only upon the player's present interaction(s) with the Wagering Opportunity with which the player is currently engaged.

According to one embodiment, the game be may be configured such that when each received player interaction with the plurality of Wagering Opportunities causes the first result (and none cause the second result), the game returns to the player no less than the overall minimum RTP. That is, no matter how inept or unlucky the player's interactions with the Wagering Opportunities prove to be, the game will return no less than the overall minimum RTP (e.g., 75% in Nevada). Conversely, when each received player interaction with the plurality of Wagering Opportunities cause the second result (and none cause the first result), the game returns, over many iterations and on average, no more to the player than the designed-for overall maximum RTP. That is, no matter how skillful or lucky the player's interactions with the Wagering Opportunities prove to be, the game, over time, will return to the player no more than the overall maximum RTP (e.g., 98.5% for example). Of course, any one game may return more than the player's inputted funds. However, over many iterations of the game, the foregoing overall maximum RTP holds. According to one embodiment, when some of the received player interactions with the plurality of Wagering Opportunities cause the first result and some others of the received player interactions cause the second result, the game may be further configured to return to the player, over the course of the game, an amount between the overall minimum RTP and the overall maximum RTP (e.g., between 75% and 98.5% in the example being developed herein).

According to one embodiment, the second result may only be selectably available during the game. That is, player interactions may not be able to cause the second result to occur all of the time or in each Wagering Event. Indeed, the second result may not be achievable all of the time, may be achievable only during predetermined times or following the occurrence of predetermined actions or the satisfaction of predetermined criteria, for example. For example, a head shot may not be possible against a headless zombie. According to one embodiment, requiring the player to kill a predetermined number of headless zombies or play for a predetermined amount of time (and/or satisfy other criteria) before being presented with the opportunity to kill a head-having zombie, may enable the game to selectively offer RTPs for predetermined actions that are even higher than the overall maximum RTP of the game.

According to some embodiments, the method may also include a mechanism that may be called virtual contributions. Indeed, for at least some of the generated Wagering Events, the method may further comprises periodically virtually contributing an amount to an accumulating counter. Thereafter, an amount related to the amount in the accumulating counter may be selectively awarded to the player when a predetermined condition or conditions are met. Such condition or conditions may include:

- the accumulating counter reaching a predetermined number;
- the accumulating counter has been increased a predetermined number of times;
- a predetermined time period has elapsed; and/or
- a predetermined player interaction received in response to the player interacting with a predetermined Wagering Opportunity.

The game may be configured to display a progress towards enabling (at least) the amount in the accumulating counter to be awarded. Such a display may be configured as a progress bar, a vessel filling with liquid, a steam-punk dial and/or any other graphical or text-based indication of the contents of the accumulating counter.

The contributions to the accumulating counter are virtual in nature because the amounts contributed to and/or already present in the accumulating counter have no monetary value to the player until the predetermined condition(s) is/are met. This predetermined condition(s) may be as simple as the presence of a gem on the track of a driving game, which gem manifests itself only when, for example, the accumulating counter reaches a predetermined number, the accumulating counter has been increased a predetermined number of times, a predetermined time period of game play has elapsed; and/or a predetermined player interaction is received in response to the player interacting with a predetermined Wagering Opportunity (such as the player achieving a minimum qualifying lap time in a driving game, for example). The contributions to the counter are also virtual in nature because the amount contributed to and already present in the accumulating counter is independent of the amount of money accepted from the player. The virtual contributions, according to embodiments, may be made to the accumulating counter for each Wagering Event or may be made a selectable percentage of the time that the Wagering Events are generated.

As foreshadowed above, some contribution to an accumulating counter may be virtually made, all of which, a portion of which or a multiple of which accumulating counter is then awarded to the player at a later time, upon the player successfully completing some next action for one or more predetermined Wagering Events. For example, after the player makes a predetermined number of wagers, a predetermined Wagering Opportunity may become enabled (that is, enabled to become a Wagering Event upon player interaction therewith) where the expected RTP of that predetermined Wagering Opportunity may be significantly higher than the overall minimum RTP, or even higher (e.g., >100%) than the overall maximum RTP, without violating the Unacceptably High Payback Rule. Because this Wagering Opportunity is only selectively available to the player (e.g., only after a predetermined number of Wagering Events, after a predetermined duration of game play or upon accomplishing predetermined actions(s)), this larger expected RTP can be funded by the previous virtual contributions made by the player as he or she places wagers on Wagering Events during the game.

According to one embodiment, at least some indication of the progress towards an award of at least the amount in the accumulating counter may be explicitly communicated to the player as he or she is playing (such as "You are 95% of the way to your bonus!"). When the amount in the accumulating counter becomes available to the player, it or a multiple thereof may automatically be awarded based on in-game activities. Indeed, at least a portion (or a multiple) of the sum of the prior virtually-contributed amounts may become available to the player based on in-game activities and based upon some predetermined action by the player in response to encountering a predetermined Wagering Event. According to one embodiment, even if the player is not successful in carrying out the predetermined and well-document action to successfully complete the Wagering Event, that player may be rewarded at least the aggregate of the virtually-contributed amounts in the accumulating counter. Should the player successfully interact with the predetermined Wagering Opportunity, the player may be awarded a multiple of the accumulated amounts present in the accumulating counter. Indeed, upon receiving a successful player interaction and generating the Wagering Event, a wheel or functional equivalent may be spun to randomly determine a multiplier: 1×, 2×, 3× or 5×, for example. This multiplier may be applied to the amount in the accumulating counter to calculate the total amount to award to the player. Alternatively, the multiplier may be simply applied to the player's next Wagering Event. According to embodiments, even if the player never successfully completed the required player interactions necessary to successfully interact with the Wagering Opportunity associated with the accumulating counter, the overall RTP of the game would, at no point during game play, drop below the specified minimum (e.g. 75%) for that gaming jurisdiction.

According to one embodiment, the specific value of the amount in the accumulating counter may not be disclosed to the player until it has been won. However, some form of meter or progress bar may be shown to the player, which meter or progress bar may depict how close the player is to the availability of the Wagering Opportunity associated with the accumulating counter. A Payout Schedule screen may be provided to the player, detailing the manner in which the multipliers (if any), and the RTP for that Wagering Opportunity are generated.

As such, virtual contributions may be thought of as a potential "stored value" on the gaming machine. It is a potential value, because it has no monetary value until the player carries out the action or actions required to realize that value. It is stored value because the player may have accumulated the amounts or tokens in the accumulating counter over time during game play, with at least some prior Wagering Events contributing to its stored and growing value. Therefore, the amount in the accumulating counter, according to embodiments, has no monetary value to the player until the player carries out some specific and well documented actions in specific and well documented circumstances. Therefore, the potential stored value of the accumulating counter is likely not regulatorily cognizable in most if not all gaming jurisdictions. Moreover, the player may not know the exact amount stored in the accumulating counter before reaching the point in the game where that amount may be rewarded. When that point in the game is reached, the player knows that he or she will be rewarded at least the amount in the accumulating counter and maybe more, and/or may benefit from a multiplier effect, further adding to the player's excitement and anticipation.

Consider the case in which the player walks away from or cashes out of a game in which he or she has accumulated a non-zero amount or a non-zero number of tokens in the accumulating counter. Even though that amount represents potential (as opposed to realized) stored value, it still represents value that may be realized in the future. Should the accumulating counter not be reset upon cashout (or some other event), "vultures" may become problematic. In the present context, vultures may be thought of as people loitering around a gaming machine waiting for a player to quit the game and walk away from a gaming machine that has a non-zero stored value in the accumulating counter. Accordingly, embodiments may be configured to clear all "stored value" to be on cashout (or some other event) automatically, at the request of the customer and/or at the request of a gaming regulator or casino operator.

Consider the exemplary Payout Schedule table shown in Table 2:

TABLE 2

| Payout | Probability | Range | RTP (calculated) |
|---|---|---|---|
| 0 | 80% | 0 . . . 79 | 0 |
| 2 | 10% | 80 . . . 89 | .20 |
| 5 | 5% | 90 . . . 94 | .25 |
| 10 | 5% | 96 . . . 99 | .550 |
| Total RTP (Sum): | | | .95 (95%) |

In this example, a random number is generated and scaled to a value between 0 and 99 (0 . . . 99). Using the "Range" column, the scaled number (0 . . . 99) is used to determine the payout amount to award the player. The "RTP (calculated)" column for each row is simply the product of the Payout and the Probability for that row. The sum of the values in this RTP column represents the overall total RTP for the entire Payout Schedule.

According to some embodiments, Payout Schedules defining lower RTPs may be enabled for some Wagering Opportunities while Payout Schedules defining comparatively higher RTPs may be enabled for other Wagering Opportunities. In some embodiments, lower RTP Payout Schedules may be enabled for Wagering Opportunities that occur often or that the player is more likely to accomplish (i.e., Easier Wagering Opportunities) while higher RTP Payout Schedules may be enabled for one or more Wagering Opportunities that occur comparatively less frequently and/or that the player is less likely to successfully accomplish (i.e., Harder Wagering Opportunities). For example, lower RTP Payout Schedules may be enabled for Easier Wagering Opportunities while higher RTP Payout Schedules trivial may be enabled for Harder Wagering Opportunities. This is in contrast to Wagering Opportunities that are associated with both lower RTP Payout Schedules and with higher RTP Payout Schedules, depending upon the result caused by received player interactions. Herein, Easier and Harder Wagering Opportunities may be measured, subjectively or objectively, by the amount of game play time required to reach them, cleverness of the player, by the amount of manual dexterity of the player, by the reaction time or speed of the player and/or by any other metric that results in a statistical differential between the rate of unsuccessfully completing a predetermined action or actions upon encountering a predetermined Wagering Opportunity and the rate of successfully completing the action or actions upon encountering the same predetermined Wagering Opportunity during game play. Indeed, the player may accept a lower rate of return for accomplishing tasks he or she (and/or the game designer) perceives as Easier in exchange for a comparatively higher rate of return for accomplishing tasks he or she (and/or the game designer) perceives as being Harder, Wagering Opportunities that conclude a chapter of the game's narrative or that are thematically significant to storyline unfolding in the game.

To illustrate the use of different RTPs for player actions that cause different results, the following paragraphs discuss a matching game. It is to be understood, however, that a First-Person Shooter, driving game or virtually any task may be substituted for the matching in the matching game discussed hereunder. It is believed that a player is willing to accept a lower reward for accomplishing Easier tasks, such as matching three like next-adjacent items (or finding the three power packs necessary to charge a ray gun capable of killing zombies, for instance). However, say the player just found a way to Match 7 items in a row, which is arguably harder to accomplish than matching three like items. If the game rewards that player with a low value (maybe zero or less than his wager), the player may become very frustrated, believing that a higher reward should be due for accomplishing Harder tasks. Indeed, it is believed that player would like to have a reward for matching 7 items (or accomplishing some other more difficult task) that is, say, 50 times his wager or more. Guaranteeing that type of payback is not addressed by simply assigning different Payback Schedules to the Match 7 Wagering Event and the Match 3 Wagering Event. This is because of the Unacceptably High Payback Rule as the Casino might end up paying the player, over time and even over many iterations, more than the player's aggregate wagers. No casinos would agree to place such a gaming machine on their floor.

As an illustration, the following presents exemplary rules of a Match 3 game, according to one embodiment. It is to be understood, however, that most (if not all) of the game parameters and characteristics may be altered to offer an entertaining experience for the player. As such, the numbers and values used below are arbitrarily chosen for purposes of clarity of explanation and should not be interpreted as limiting any embodiment described herein.

In this particular embodiment, the game is an object-matching game having functionality similar to that of the arcade game Bejeweled™. Here, it is assumed that the player places a wager and is presented with a playing board (a matrix) of items such as gems. The player is expected to identify and select 3 or more gems (or other objects, animals, etc.) of the same type (e.g. red gems, blue gems, tigers, foxes, ducks and the like) that are next adjacent to one another (left, right, top, bottom, diagonally) on the playing board. Each time gems or other objects are matched, they are removed from the playing board and replaced by new gems or objects. A player begins the game with only Match 3 actions available on the playing board (or one type of slow-moving dead-eyed zombie or zombies attacking him or her within the computer-rendered apocalyptic urban zombie spawning grounds). Match 4, 5, 6, (or more capable zombies) actions are not available at the start of the game as the playing board, at this stage of the game, does not include 4, 5 or 6 next adjacent gems or objects or the user is not initially presented with such higher-valued game assets.

A low-numbered Match Wagering Event (e.g., Match-3) may offer the player a lower RTP. Each time the player makes a Match wager, an accumulating counter may be incremented or there may be a random chance of incrementing the accumulating counter and by making a sufficient number of Match wagers, the player will unlock Bonus-4, Bonus-5, Bonus-6 and Bonus-7 pays that are triggered by making matching 4 items (Match-4), matching 5 items (Match-5), matching 6 items (Match-6) or matching 7 items (Match-7) respectively. Instead of higher-order Match Wagering Opportunities, faster or more agile zombies may present themselves for battle. If a higher bonus is not yet available, higher matches will trigger the lowest bonus available. For example, a Match-7 can trigger a Bonus-6 if that is the highest-level bonus currently available.

Each of these subsequent Wagering Opportunities (i.e., Match-4, Match-5, Match-6, Match-7 Wagering Opportunities), may be associated with and provide the player with more than 100% of his or her wager; that is, provide a greater than 100% RTP. However, such greater RTPs for Harder Wagering Opportunities (i.e., the opportunity to match 4, 5, 6 or 7 next-adjacent like items) may only be available to the player after a predetermined number of lower-valued Match wagers have been made. This is how, according to embodiments, the greater-than-100% RTP Payout Schedules are made possible and funded.

For illustration purposes, consider a simplified embodiment in which only two Wagering Opportunities are selectively made available: a plurality of first, "Match-3" Wagering Opportunities and one or more second, "Match-More" Wagering Opportunities, along with a bonus or bounty Payout Schedule called "Bonus-More". The Payout Schedule for such a Match-3 Wagering Event may take the form shown in Table 3:

TABLE 3

| Payout | Probability | Range | RTP (calculated) |
|---|---|---|---|
| 0 | 80% | 0 . . . 79 | 0 |
| 1 | 10% | 80 . . . 89 | .10 |
| 5 | 5% | 90 . . . 94 | .25 |
| 10 | 5% | 96 . . . 99 | .50 |
| Total RTP (Sum) | | | .85 (85%) |

The Payout Schedule for such a Match-More Wagering Event may take the form shown in Table 4:

TABLE 4

| Payout | Probability | Range | RTP (calculated) |
|---|---|---|---|
| 0 | 75% | 0 . . . 79 | 0 |
| 1 | 15% | 80 . . . 89 | .15 |
| 5 | 5% | 90 . . . 94 | .25 |
| 10 | 5% | 96 . . . 99 | .50 |
| Total RTP (Sum) | | | .90 (90%) |

However, it is desired for the game to have an overall 95% RTP. To accomplish this, the Payout Schedule for the Bonus-More Wagering Events may be designed to return greater than 100% of the player's wager. For example, the Payout Schedule for Bonus-More Wagering Events may take the form of Table 5:

TABLE 5

| Payout | Probability | Range | RTP (calculated) |
|---|---|---|---|
| 0 | 80% | 0 . . . 79 | 0 |
| 10 | 10% | 80 . . . 89 | 1.0 |
| 25 | 5% | 90 . . . 94 | 1.25 |
| 50 | 5% | 96 . . . 99 | 2.5 |
| Total RTP (Sum) | | | 4.75 (475%) |

The 475% RTP, however, does not cause the game, according to embodiments, to violate the Unacceptably High Payback rule. This is because, according to one embodiment, the player will not have access to a Bonus-More Wagering Opportunity until he or she has made a predetermined number of Match-3 wagers (or accumulated a predetermined number of tokens which may or may not be awarded for each first Match-3 Wagering Event). Below, for purposes of illustration only, it is assumed that a second Bonus-More Wagering Opportunity is made available after 10 tokens have been added to the "Bonus-More" meter, earned through interacting with a number of Match-3 Wagering Events (a token need not be awarded for every Match-3 Wagering Event). The Bonus-More meters may be visible to the player.

The following describes the manner in which high RTPs may be offered for higher-valued Wagering Events, according to illustrative implementation. Since the target overall RTP of the game is to be set in this example at 95%, this 95% can be subtracted from the 475% RTP of the Bonus-More RTP to yield a difference of 380%. For each first Match-3 Wagering Event, the RTP is deficient from the target overall RTP of 95% by 10%, as 95%-85%=10%. This deficiency can be made up by requiring the player to make, on average, 38 (380%/10%) first Match-3 wagers before enabling a Match-More wager to trigger a Wagering Event in which the Bonus-More bonus (which may be or include at least the amount in the accumulating counter). This can be achieved this by contributing a token 26.3% of the time a Match-3 Wagering Event occurs thereby, on average, accumulating 10 tokens over 38 Match-3 Wagering Events. Together, the Match-3 RTP and the Bonus-More RTP yields $$85\%+1*475\%=37.05$$

Over the 38 Match-3 Wagering Events and the 1 Match-More Wagering Event, on average, the overall RTP becomes the desired 95%, as 37.05/39=0.95 or 95%.

However, when the player does a "Match-More" play, their immediate payback will be at 90%, requiring that the chance of incrementing a token be decreased accordingly. It is then required to ensure that the play in which the player may be awarded the amount in the accumulating counter only contributes 5% for each "Match-More" wager (95%-90%=5%). To do this, the contribution probability is cut in half and a token is contributed at a rate of 13.15% (a token is contributed 13.5% of the time), thereby requiring the player to play an average of 76 lower-valued Wagering Events to enable the Wagering Event in which the amount in the accumulating counter may be won or used as multiplier. This yields the following calculation for the for the "Match-More"+"Bonus-More" RTP:

$$90\%+1*475\%=73.15$$

$$73.15/77=0.95(95\%)$$

As with the Match-3, the division is by 77 because there would have been a total of 76+1=77 Wagering Events to yield an outcome of 73.15.

According to embodiments, in order to support changing bet sizes at arbitrary points in the game, the token count may be always incremented by the bet amount. According to embodiments, the number of tokens earned must then exceed the base token threshold multiplied by the bet size in order to activate the bonus. Consequently, a player that increases his or her bet size between plays may disable their bonus. The gaming machine may then display the accumulating counter as the token count divided by the current bet size. Also, there may be occurrences where tokens are unusable until the bet size is reduced due to rounding of the tokens.

For example: If an accumulating counter requires 10 tokens to fill at a 1 credit bet it will require 400 tokens to fill at a 40-credit bet. If the player plays at 10 credits and accumulates 50 tokens and half fills the accumulating counter, switching to a 5 bet will immediately increase the accumulating counter to 100% full.

According to some embodiments, the Match-More Wagering Event may be replaced by an altogether different Wagering Opportunity; that is, not just an opportunity to match a number of items greater than three. For example, after having accumulated 10 tokens as described above, the player may be challenged by a new and different Wagering Opportunity that bears only some (or no) similarity to the Match-3 Wagering Events that enabled the new and different Wagering Opportunity. For example, the player may be tasked with a match Wagering Opportunity that is perceived to be significantly Harder to achieve than the matching tasks that led the player to this point in the game. Alternatively, the player may be presented with another challenge altogether, such as throwing virtual darts at balloons or any other entertaining and engaging task that may be considered to be subjectively Harder to accomplish. In a scripted console-type game that immerses the player in a virtualized game world, the challenge embodied by the Wagering Opportunity may be thematically significant to the narrative or resolve some tension that has been building up in the story up to that point—or may be simply the next Wagering Opportunity encountered. If the player successfully carries out the intended action (popping all balloons, for example), the player may be awarded all or a randomly-chosen multiple of the amount in the accumulating counter or a determination of the multiplier to apply to the next Wagering Opportunity may be randomly made. The amount thus awarded may be sized such that the player, by carrying out the intended action or actions, makes a wager and wins an amount determined by a higher-than 100% RTP Payout Schedule associated with this wager. In this manner and according to embodiments, players that consistently carry out the intended action(s) required by Wagering Event associated with the accumulating counter will, over time and on average, earn back the intended, designed-for maximum overall RTP (e.g., 95%) of the game. Similarly, players that consistently fail to carry out the intended action(s) required by Wagering Event associated with the accumulating counter will, over time and on average, earn back at least the intended minimum RTP (e.g., 75%), but less than the designed-for maximum overall RTP of the game. Of course, a player that is only sometimes successful in carrying out the intended action(s) required by Wagering Event associated with the accumulating counter will, over time and on average, earn back somewhere between the intended minimum RTP (e.g., 75%) and the intended maximum RTP (e.g., 95%).

To further illustrate the use of higher-valued Payout Schedules for Harder Wagering Events, the following paragraphs discuss a regulated Match game in greater detail. Such a Match game is predicated upon the belief that players are willing to accept lower rewards for accomplishing Easier tasks, in exchange for higher rewards for Harder tasks. Exemplary rules of a more complex, multi-tiered Match game using virtual contributions, according to one embodiment, may be as follows. It is to be understood, however, that most (if not all) of the game parameters and characteristics may be altered to offer an entertaining experience for the player. As such, the numbers and values used below are arbitrarily chosen for purposes of clarity of explanation and should not be interpreted as limiting any embodiment described herein.

Every time that a player Matches 3, the player effectively places a wager and is rewarded (or not) according to a Payout Schedule with a Value of 95%. The player will be awarded one C3 counter (Match-3 counter) for this Wagering Event. In this implementation, the Value of each C3 Counter is 15%, which is "taken out of", or virtually contributed from the 95% intended overall RTP of the game. Note that the award of a Counter (C3 or other) need not be guaranteed. There may be a "chance to award a counter". In this manner, multiplying the probability of a Counter by the value of the Counter yields the value that can be added to the Payout Schedule(s) of the subsequent tiers' Wagering Events.

Once five (5) such C3 counters are accumulated by the player, a Match-4 Wagering Event is enabled and the five C3 counters are removed. This allows some other action or event in the game to become a Wagering Event. In other words, the action or event in the game was not a Wagering Event until the 5 C3 counters were accumulated, the Match-4 Wagering Event enabled and the 5 C3 counters removed. The player must still interact with a predetermined in-game asset, perform the action or otherwise cause this next Wagering Event to occur. There is no guarantee at any point in time that the Wagering Event is available for the player. Indeed, just because the game currently allows a Match 7 or other Wagering Event to occur does not guarantee that there are currently 7 appropriate items or gems to match or that the game offers a like Wagering Opportunity to the player. In conventional games, once the 5 Counters are collected, something occurs automatically, such as entering a bonus game, receiving an immediate payout, etc. Sometimes, therefore, it is to be anticipated that a Match-N Wagering Event may be enabled when there are no N items currently available for matching. Such a Wagering Opportunity, however, may present itself at some later time during game play, at which time the player will have the opportunity to carry out the intended action(s) and place a wager on the now-available higher-valued Wagering Opportunity.

According to some embodiments, prior to this point, the player was not allowed to take a Match 4 action. In some other embodiments, the Match 4 action would be available to the player, but not as a Wagering Opportunity that is configured to enable or generate a Wagering Event, thereby preventing the player from wagering or winning any amount from that not-yet-enabled action. Alternate embodiments may allow the Match 4 action to be taken, but to be treated as a Match 3 Wagering Event (at the lower valued Payout Schedule). Alternatively, the Match 4 action may be taken by treated as the highest-level Match N that is enabled at the time (e.g. if a Match 7 is found, but the highest enabled action is Match 5, then the Match 7 action would be treated as if it were a Match 5) In some embodiments the player may be prompted or asked if he would like to accept this "lower" Wagering Event when this situation occurs.

Because five such C3 counters were required to enable this action, the Match 4 Payout Schedule Value is set to 115%, 20% higher than the 95% Payout Schedule for Match 3. Even though each C3 Counter was valued at 15%, 10% of each of each of these counters is not used for Match 4. Significantly, only one (1) Match 4 action may be enabled and once a Match 4 action is found and taken by the player, that Match 4 action may be disabled again. In an alternate embodiment, each Match level has an "enabled counter" that is incremented when the lower level counters are fully collected and decremented every time that the Match is made. e.g. say fifteen (15) Match 3 Wagering Events occur consecutively. This would enable three (3) opportunities to take a Match 4 action. Among other benefits, this would make the overall payback of the game more stable.

Similarly, each Match 4 Wagering Event may award the player a C4 Counter valued at the virtually-contributed 10% (taken out of the 115%). After five (5) of these C4 counters are accumulated, the Match 5 action is enabled (again—for only one Wagering Event). However, because both the C3 and C4 counters are contributing a total of 300% (50% from 5×C4 (10% each) counters and 250% from 5×5=25 C3 (10% each) counters), the Match 5 Payout Schedule Value can be up to 400% without violating the Unacceptably High Payback Rule. This tiered scheme according to embodiments may be continued with virtual contributions to higher-ordered Wagering Events.

This contribution of 10% is a simple example. For the Harder Wagering Events to have a significantly higher Value, one embodiment is configured such that part of every (or at least some) Easier Wagering Event's Counter's value is virtually contributed to the Harder Wagering Event. It may be a desirable game design decision to set the value of the C3 counters to 50% or higher, virtually contributing and forwarding some portion (e.g., most, in one implementation) of the Value to the Harder Wagering Events and returning only small amounts (if any) to the player for the Easiest Wagering Events. Further, the virtual contribution of a constant percentage to fund Harder Wagering Events is not the only contribution mechanism available to the game designer. For example, a Payout Schedule could be used to determine how much to virtually contribute forward. For instance, for the C3 counters, a Payout Schedule with a Value of 15% could be forwarded. Further, the proportions of the 15% from C3 counters that are contributed to the C4 and C5 (in this example) may themselves be Payout Schedules, either in combination with or instead of the aforementioned 15% C3 forwarded Value.

Finally, it may be a desirable game design decision to provide the ability to "force" or "guarantee" the availability of a higher-tiered Wagering Event if one isn't available when it becomes enabled (via collection of Counters). This may be implemented as a "magic wand" effect whereby, after maybe one minute where no Match 7 opportunity has presented itself, the game modifies one or more gems such that a Match 7 opportunity becomes available immediately, or perhaps becomes obviously available by taking a much simpler Match 3 action.

Inherent in embodiments is the notion of anticipated wins, whereby a player becomes more invested in the game the longer he plays the game. i.e. If the player knew he or she was very close to unlocking a major potential winning action (whether a Match 7 Wagering Opportunity or similar higher-level Wagering Opportunity), that player would be more likely to continue playing that gaming device. In this manner, continued play equates to a more exciting entertainment experience for the player and with increased revenue for the casino.

As noted above, the second result may only be selectably available (i.e., not available all of the time and/or only available when predetermined conditions are met) during the game. In such cases, the second RTP may be designed to be greater than the overall maximum RTP of the game—without violating the Unacceptably High Payback rule.

Figure 11:
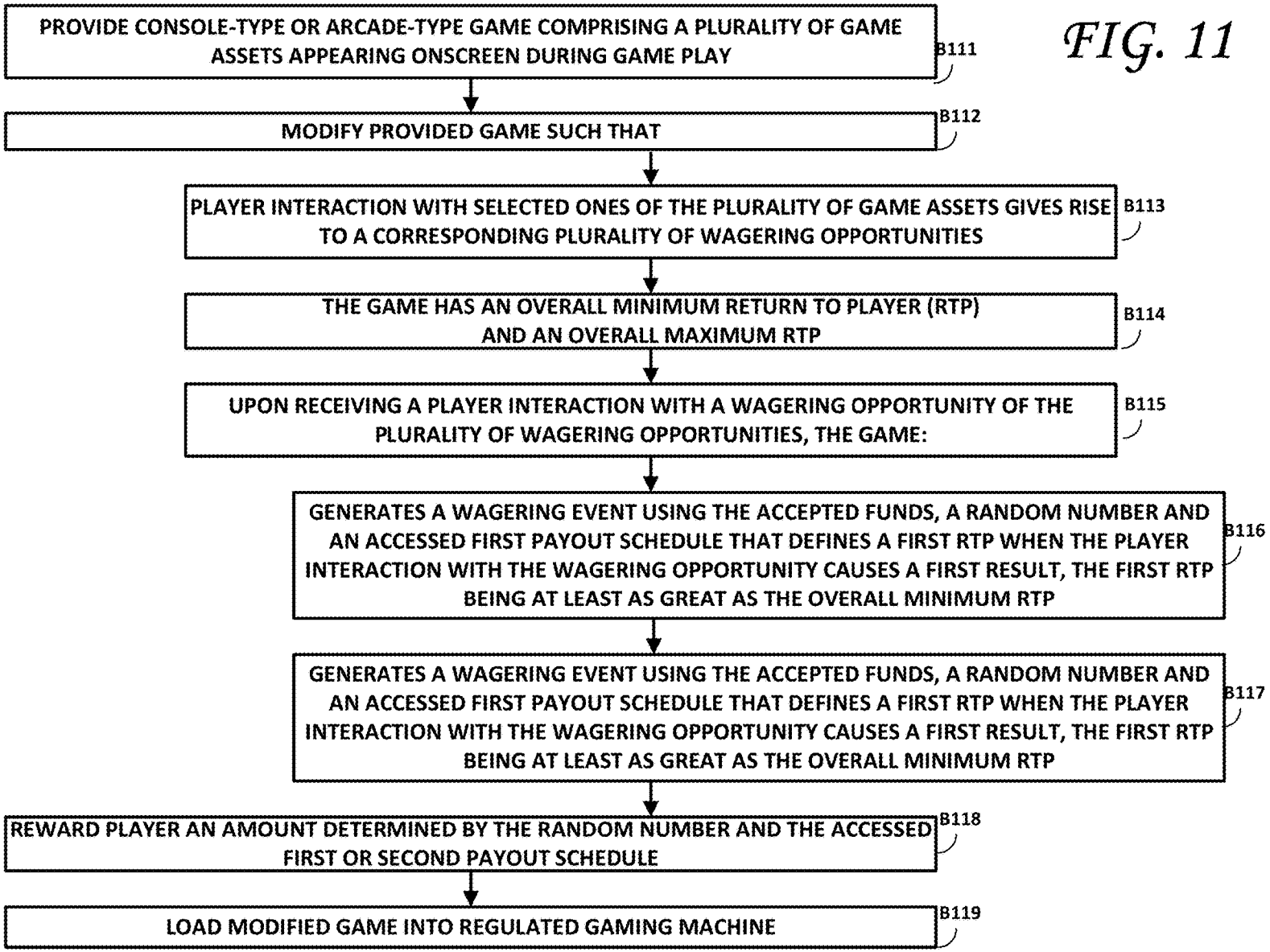
FIG. 11 is a flowchart of a method according to one embodiment.

FIG. 11 is a flowchart of another method according to one embodiment. In particular, FIG. 11 is a flowchart of a method of providing a game for a regulated gaming machine. Such a method may be carried out, for example, by a developer of games for regulated, wager-based games. As shown, Block B111 calls for providing an existing console-type game or arcade-type game. The provided game may natively comprise a plurality of game assets (characters, objects, etc.) appearing onscreen during game play that may be reconfigured as Wagering Opportunities that may trigger corresponding Wagering Events. In one embodiment, a new console-type or arcade-type game may be developed especially for this purpose. However, it may be beneficial to leverage the goodwill and fan base of popular existing games to appeal to particular demographics. For example, versions of popular games such as Halo, Call of Duty, Grand Theft Auto, Biohazard, MassEffect and the like may be adapted for wager-based gaming according to embodiments.

As shown at B112, the provided game may be modified such that:

player interaction with selected ones of the plurality of game assets gives rise to a corresponding plurality of Wagering Opportunities, as shown at B113;

the game has an overall minimum RTP and an overall maximum RTP, as called for by block B114;

upon receiving a player interaction with a Wagering Opportunity, as shown at B115, the game, as modified herein either:

a) generates a Wagering Event using the accepted funds, a random number and an accessed first payout schedule that defines a first RTP when the player interaction with the Wagering Opportunity causes a first result, the first RTP being at least as great as the overall minimum RTP, as shown at B116, or b) generates a Wagering Event using the accepted funds, the random number and an accessed second payout schedule that defines a second RTP when the player interaction with the Wagering Opportunity causes a second result, the second RTP being greater than the first RTP, as called for by block B117.

The player may then be rewarded, as shown at B118, an amount (if any) determined by the random number and the accessed first payout schedule or second payout schedule. As shown at B119, the modified (or newly-developed) game may be loaded into the regulated gaming machine, and placed on the casino floor, after having met all regulatory requirements.

Figure 12:
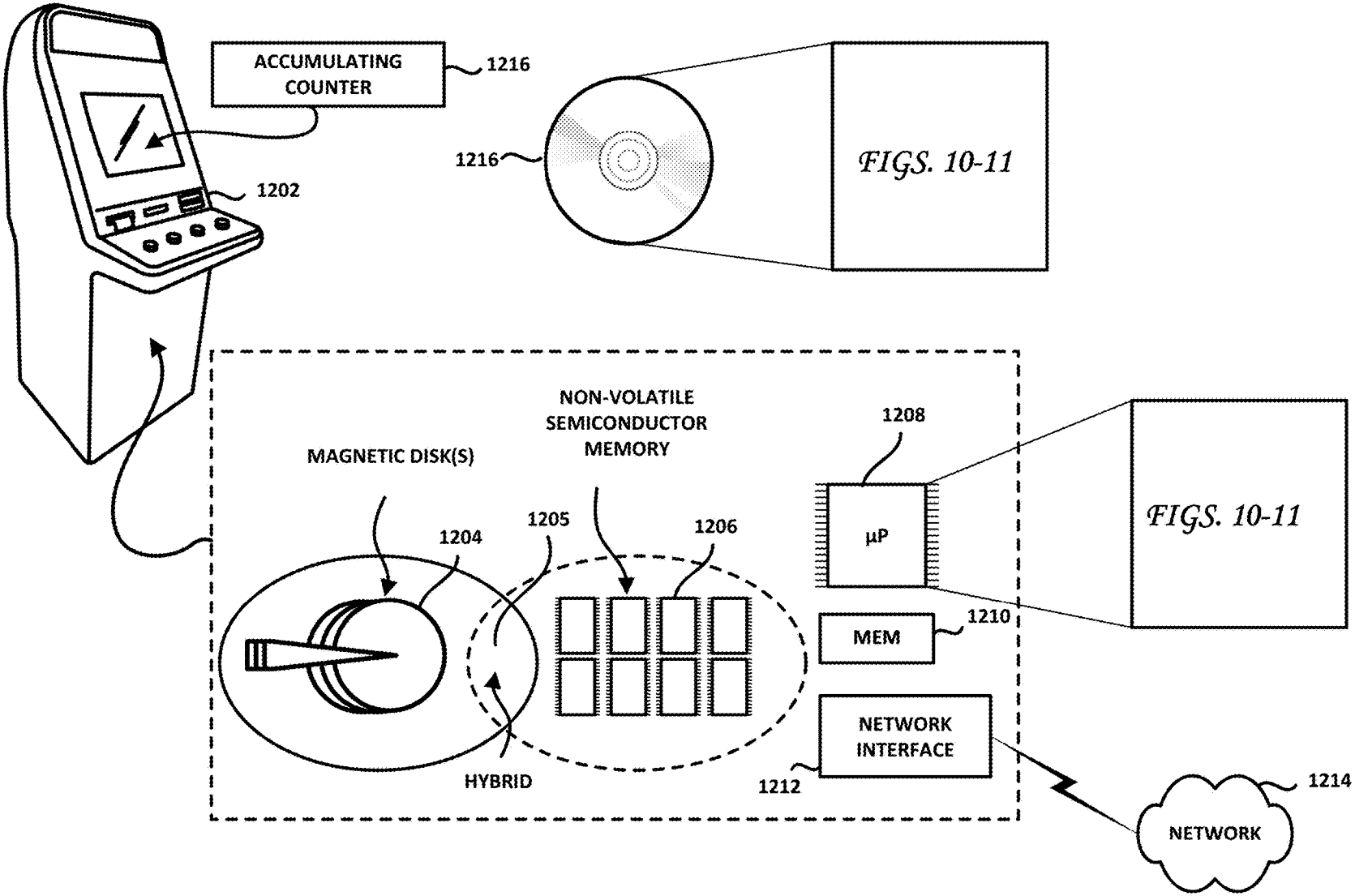
FIG. 12 shows a wager-based regulated gaming machine configured according to embodiments.

FIG. 12 shows a wager-based regulated gaming machine configured according to embodiments. FIG. 12 also shows exemplary tangible, non-transitory computer-readable media having data stored thereon representing sequences of instructions which, when executed by the regulated gaming computing device, cause the regulated gaming computing device to determine rewards due to a player playing a wager-based game according to embodiments. As shown therein, reference number 1202 is a regulated gaming machine, also referenced herein as an electronic gaming device (EGD) and electronic gaming machine (EGM). The regulated gaming machine 1202 may comprise direct access data storage devices such as magnetic disks 1204, non-volatile semiconductor memories (EEPROM, Flash, etc.) 1206, a hybrid data storage device comprising both magnetic disks 1204 and non-volatile semiconductor memories, as suggested at 1205, one or more microprocessors 1208 and volatile memory 1210. The microprocessor(s) 1208 may be configured to execute sequence of machine-readable instructions that are configured to carry out the functionality of FIGS. 10 and/or 11. The regulated gaming machine 1202 may also comprise a network interface 1212, configured to communicate over network 1214 with remote servers (not shown in FIG. 12). References 1204, 1205 and 1206 are examples of tangible, non-transitory computer-readable media having data stored thereon representing sequences of instructions which, when executed by a regulated gaming computing device, cause the regulated gaming computing device to determine rewards due to a player playing a wager-based game as described and shown herein. Some of these instructions may be stored locally in the gaming machine 1202, while others of these instructions may be stored (and/or executed) remotely and communicated to the gaming machine 1202 over the network 1214. In other embodiments, all of these instructions may be stored locally in the gaming machine 1202, while in still other embodiments, all of these instructions are stored and executed remotely, based on payer interactions at the gaming machine 1202, and the results communicated to the gaming machine 1202. In another embodiment, the instructions may be stored on another form of a tangible, non-transitory computer readable medium, such as shown at 1216. For example, reference 1216 may be implemented as an optical disk, which may constitute a suitable data carrier to load the instructions stored thereon onto the gaming machine 1202, thereby re-configuring the gaming machine to one or more of the embodiments described and shown herein. In other implementations, reference 1216 may be embodied as an encrypted Flash drive. Other implementations are possible.

In the foregoing description, numerous specific details are set forth in order to provide a thorough understanding of one or more aspects and/or features of the exemplary embodiments. It will be apparent to one skilled in the art, however, that one or more aspects and/or features described herein may be omitted in favor of others or omitted all together. In some instances, the description of well-known process steps and/or structures are omitted for clarity or for the sake of brevity.

Herein, devices or processes that are described as being in communication with each other need not be in continuous communication with each other, unless expressly specified otherwise. In addition, devices or processes that are disclosed to be in communication with one another may communicate directly or indirectly through one or more intermediaries.

Further, although constituent steps of methods have been described in a sequential order, such methods may be configured to work in alternate orders. In other words, any sequence or order of steps that may be described herein does not, in and of itself, indicate a requirement that the steps be performed in that order. The steps of described processes may be performed in an order that differs from the order described herein. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred over other processes.

When a single device or article is described, it will be readily apparent that more than one device/article (e.g., whether or not they cooperate) may be used in place of a single device/article. Similarly, where more than one device or article is described (e.g., whether or not they cooperate), it will be readily apparent that a single device/article may be used in place of the more than one device or article. The functionality and/or the features of a device may be alternatively embodied by one or more other devices that are not explicitly described as having such functionality/features.

Lastly, while certain embodiments of the disclosure have been described, these embodiments have been presented by way of example only, and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. A method of determining awards due to a player playing a first person shooter game in a gaming machine, the method comprising:

providing, in the gaming machine, a game configured such that a plurality of game assets within the game are configured as a corresponding plurality of Wagering Opportunities, the game being further configured to have an overall minimum return to player (RTP) and an overall maximum RTP;

accepting funds from the player and initiating a game session;

upon receiving at least one player interaction with a Wagering Opportunity of the plurality of Wagering Opportunities during the game session, performing one of;

a) generating a Wagering Event using the accepted funds, a random number, and an accessed first payout schedule that defines a first RTP when the received player interaction with the Wagering Opportunity is successful and results in a kill shot; and generating a Wagering Event using the accepted funds, the random number and an accessed second payout schedule that defines a second RTP when the received player interaction with the Wagering Opportunity is successful but does not result in a kill shot the second RTP being less than the first RTP;

rewarding the player an amount determined by the random number and the accessed one of the first payout schedule and the second payout schedule, whichever of the first and second payout schedules is accessed upon receiving the successful player interaction with the Wagering Opportunity being based solely upon whether there was a resulting kill shot caused by the just-performed player interaction with the Wagering Opportunity and unrelated to past player interactions, past interactions with the Wagering Opportunity, another Wagering Opportunity, measured player skill, or previously-achieved first or second results.

2. The method of claim 1, wherein the received player interaction that causes the kill shot requires greater skill than the player interaction that is successful but that is not a kill shot.

3. The method of claim 1, further comprising not generating a wagering event or awarding the player whenever the received player interaction with the wagering opportunity is not successful.

4. The method of claim 1, wherein randomly awarding the player an amount determined according to the second RTP comprises returning to the player no less than an overall minimum RTP of the game.

5. The method of claim 1, wherein randomly awarding the player an amount determined according to the first RTP comprises returning to the player no more than an overall maximum RTP of the game.

6. The method of claim 1, wherein randomly awarding the player an amount determined according to the first RTP comprises returning to the player an amount greater than an overall maximum RTP of the game.

7. The method of claim 1, wherein when some of the received player interactions result in a kill shot and others of the received player interactions are successful but do not result a kill shot, the method further comprises returning to the player, over the course of the game, an amount between the overall minimum RTP and the overall maximum RTP of the game.

8. The method of claim 1, wherein the second RTP is greater than the overall maximum RTP of the game.

9. The method of claim 1, wherein for at least some of the Wagering Opportunities with which the player has interacted, the method further comprises virtually contributing an amount to an accumulating counter.

10. The method of claim 9, further comprising selectively awarding at least an amount corresponding to the amount in the accumulating counter when a predetermined condition is met.

11. An electronic, wager-based gaming machine, comprising:

a memory;

a processor, and a plurality of processes spawned by the processor, the plurality of processes comprising processing logic to:

provide, in the gaming machine, a game configured such that a plurality of game assets within the game are configured as a corresponding plurality of Wagering Opportunities, the game being further configured to have an overall minimum return to player (RTP) and an overall maximum RTP;

accept funds from a player and initiate a game session;

upon receiving at least one player interaction with a Wagering Opportunity of the plurality of Wagering Opportunities during the game session, perform one of:

a) generate a Wagering Event using the accepted funds, a random number and an accessed first payout schedule that defines a first RTP when the received player interaction with the Wagering Opportunity is successful and results in a kill shot, the first RTP being at least as great as the overall minimum RTP; and b) generate a Wagering Event using the accepted funds, the random number and an accessed second payout schedule that defines a second RTP when the received player interaction with the Wagering Opportunity is successful but does not result in a kill shot, wherein the second RTP is less than the first RTP and reward the player an amount determined by the random number and the accessed one of the first payout schedule and the second payout schedule accessed upon receiving the player interaction with the Wagering Opportunity being based solely upon whether there was a resulting kill shot caused by the just-performed player interaction with the Wagering Opportunity and unrelated to past player interactions, past interactions with the Wagering Opportunity, another Wagering Opportunity, measured player skill, or previously-achieved first or second results.

12. The gaming machine of claim 11, wherein the received player interaction that causes the kill shot is requires greater skill than the player interaction that is successful but that is not a kill shot.

13. The gaming machine of claim 11, further comprising processing logic for not generating a wagering event or awarding the player whenever the received player interaction with the Wagering Opportunity is not successful.

14. The gaming machine of claim 11, wherein the processing logic for randomly awarding the player an amount determined according to the second RTP comprises processing logic for returning to the player no less than an overall minimum RTP of the game.

15. The gaming machine of claim 11, wherein the processing logic for randomly awarding the player an amount determined according to the first RTP comprises processing logic for returning to the player no more than an overall maximum RTP of the game.

16. The gaming machine of claim 11, wherein the processing logic for randomly awarding the player an amount determined according to the first RTP comprises processing logic for returning to the player an amount greater than an overall maximum RTP of the game.

17. The gaming machine of claim 11, wherein when some of the received player interactions result in a kill shot and others of the received player interactions are successful but do not result a kill shot, the gaming device further comprises processing logic for returning to the player, over the course of the game, an amount between the overall minimum RTP and the overall maximum RTP of the game.

18. The gaming machine of claim 11, wherein the first RTP is greater than an overall maximum RTP of the game.

19. The gaming machine of claim 11, wherein for at least some of the Wagering Opportunities with which the player has interacted, the gaming device further comprises processing logic for virtually contributing an amount to an accumulating counter.

20. The gaming machine of claim 19, further comprising processing logic for selectively awarding at least the amount in the accumulating counter when a predetermined condition is met.

21. A tangible, non-transitory computer-readable medium having data stored thereon representing sequences of instructions which, when executed by a gaming machine, cause the regulated gaming machine to determine rewards due to a player playing a wager-based game by:

providing, in the gaming machine, a game configured such that a plurality of game assets within the game are configured as a corresponding plurality of Wagering Opportunities, the game being further configured to have an overall minimum return to player (RTP) and an overall maximum RTP;

accepting funds from a player and initiating a game session;

upon receiving at least one player interaction with a Wagering Opportunity of the plurality of Wagering Opportunities during the game session, performing one of:

a) generating a Wagering Event using the accepted funds, a random number, and an accessed first payout schedule that defines a first RTP when the received player interaction with the Wagering Opportunity is successful and results in a kill shot; and b) generating a Wagering Event using the accepted funds, the random number and an accessed second payout schedule that defines a second RTP when the received player interaction with the Wagering Opportunity is successful but does not result in a kill shot the second RTP being less than the first RTP;

rewarding the player an amount determined by the random number and the accessed one of the first payout schedule and the second payout schedule based whichever of the first and second payout schedules is accessed upon receiving the successful player interaction with the Wagering Opportunity being based solely upon whether there was a resulting kill shot caused by the just-performed player interaction with the Wagering Opportunity and unrelated to past player interactions, past interactions with the Wagering Opportunity, another Wagering Opportunity, measured player skill, or previously-achieved first or second results.

* * * * *